US006241344B1

(12) United States Patent
Machida

(10) Patent No.: US 6,241,344 B1
(45) Date of Patent: Jun. 5, 2001

(54) IMAGE FORMING METHOD AND IMAGE FORMING APPARATUS

(75) Inventor: Yoshinori Machida, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/184,287

(22) Filed: Nov. 2, 1998

(30) Foreign Application Priority Data

Nov. 10, 1997 (JP) ..... 9-307717

(51) Int. Cl.[7] ..... B41J 2/05

(52) U.S. Cl. ..... 347/66; 347/89; 347/91; 347/56

(58) Field of Search ..... 347/91, 89, 66, 347/60, 56, 44, 20, 102

(56) References Cited

U.S. PATENT DOCUMENTS

| | | | | |
|---|---|---|---|---|
| 4,227,452 | * | 10/1980 | Tamai | 101/1 |
| 4,725,860 | * | 2/1988 | Kohyama et al. | 346/140 |
| 4,855,768 | * | 8/1989 | Iino et al. | 346/160 |
| 4,889,560 | * | 12/1989 | Jaeger et al. | 106/31.29 |
| 5,623,296 | * | 4/1997 | Fujino et al. | 347/103 |
| 5,760,808 | * | 6/1998 | Wiedemer | 347/103 |
| 5,761,597 | * | 6/1998 | Smith et al. | 399/339 |

FOREIGN PATENT DOCUMENTS

| | | |
|---|---|---|
| 51-132036 | 11/1976 | (JP) . |
| 53-12138 | 4/1978 | (JP) . |
| 53-45698 | 12/1978 | (JP) . |
| 54-51837 | 4/1979 | (JP) . |
| 54-59139 | 5/1979 | (JP) . |
| 56-4467 | 1/1981 | (JP) . |
| 61-118273 | 6/1986 | (JP) . |
| 62-90257 | 4/1987 | (JP) . |
| 62-184860 | 8/1987 | (JP) . |
| 8-281932 | 10/1996 | (JP) . |
| 9-196111 | 6/1997 | (JP) . |
| 9-207429 | 8/1997 | (JP) . |

* cited by examiner

*Primary Examiner*—John Barlow
*Assistant Examiner*—Blaise L Mouttet
(74) *Attorney, Agent, or Firm*—Oliff & Berridge, PLC

(57) ABSTRACT

An image forming method and an image forming apparatus which are capable of jetting ink having high viscosity stably without incremental energy consumption, at a small quantity, and at high speed, and capable of forming high quality and highly precise images without feathering and bleeding on various recording media at high speed are provided. Color ink is held on a flat surface of an ink carrier in the form of a uniform pattern, and the ink carrier is partially heated correspondingly to image information. Then, an air layer is formed on the interface or near the interface between the ink carrier and the color ink. The color ink is jetted by the pressure generated when the air layer is formed to adhere on a recording medium, and thus an image is formed. Particularly, the color ink held on the ink carrier in the form of isolated ink droplets receives an extremely low and uniform resistance force due to the peripheral color ink, therefore, even though color ink having high viscosity is used, ink droplets are jetted stably with small energy and at high speed for recording.

14 Claims, 14 Drawing Sheets

Fig. 2
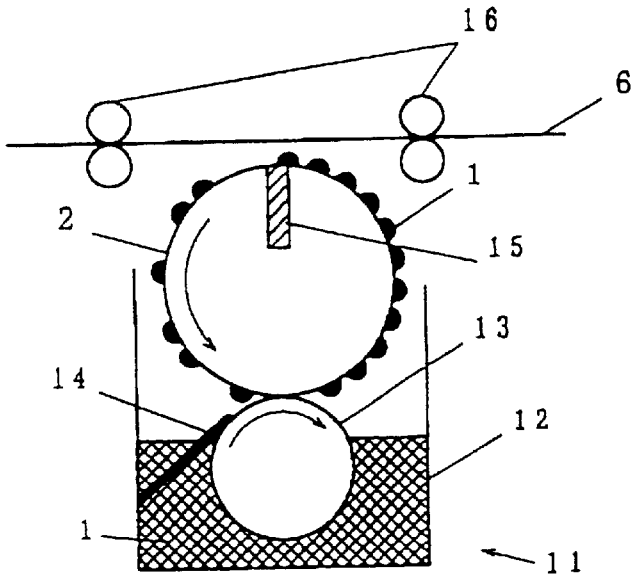
Fig. 3(A)
Fig. 3(B)
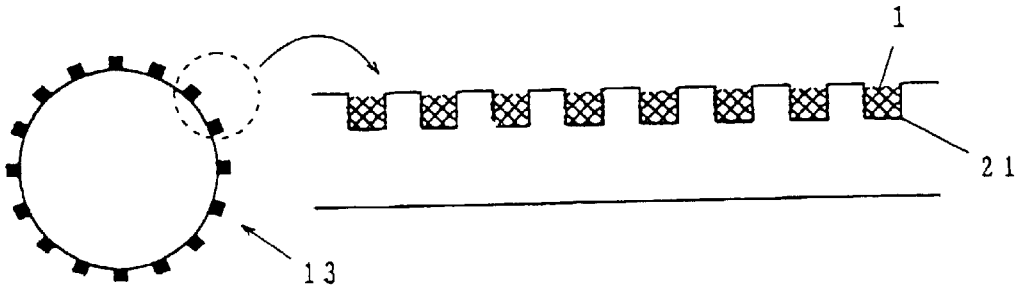
Fig. 4(A)
Fig. 4(B)
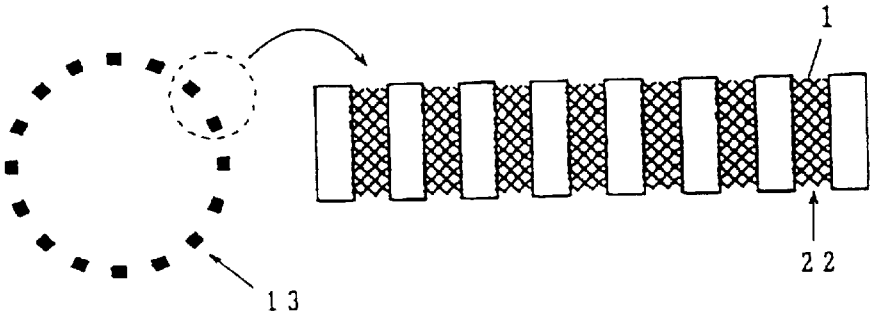

(PRIOR ART)
Fig. 5(A)
(PRIOR ART)
Fig. 5(B)
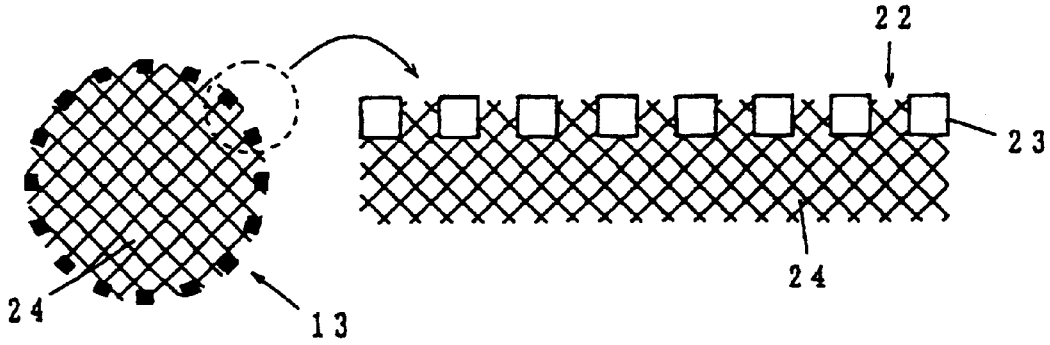
Fig. 6
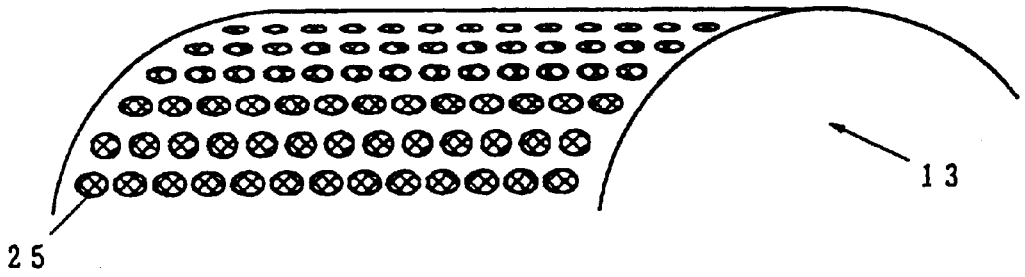
Fig. 7
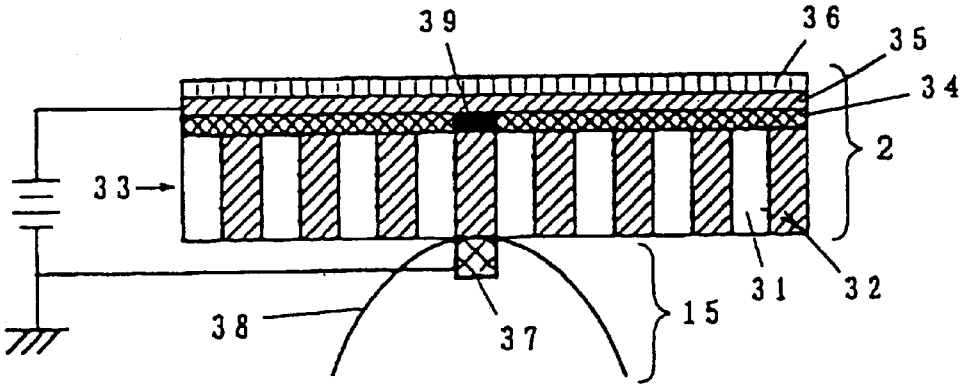

Fig. 20

| Ink viscosity | Ink layer thickness 5 μm | Ink layer thickness 10 μm | Ink layer thickness 15 μm | Ink layer thickness 20 μm | Ink layer thickness 30 μm | Ink layer thickness 50 μm |
|---|---|---|---|---|---|---|
| 1mPa・s | B | B | B | B | B | B |
| 10mPa・s | A | A | B | B | B | B |
| 100mPa・s | A | A | A | B | C | C |
| 1000mPa・s | A | A | B | C | C | C |
| 10000mPa・s | B | C | C | C | C | C |

(PRIOR ART)

IMAGE FORMING METHOD AND IMAGE FORMING APPARATUS

BACKGROUND OF THE INVENTION

1. Field of the Invention

This invention relates to an image forming apparatus which jets ink to adhere on a recording medium and to form an image.

2. Description of the Related Art

Heretofore, various non-impact recording type image forming apparatuses including electrophotographic systems have been developed. Among these non-impact recording systems, on-demand type ink jet recording systems, which are advantageous in price reduction, reduction of running cost, minimization of the apparatus, and low noise level, have drawn attention, and various types of ink jet recording apparatuses have been developed and commercialized.

A typical on-demand type ink jet recording apparatus is provided with a passage for supplying ink, a nozzle or an aperture for jetting ink, and a mechanism for generating a pressure to jet ink. In particular, the thermal type which uses a heat generating element and the piezoelectric type which uses a piezoelectric element as a mechanism for generating the pressure have been known as the typical on-demand types. In the thermal type, ink droplets are jetted from the nozzle head with a vapor pressure generated by heat generated from a heater provided in an ink passage and adheres on a recording medium, and an image is formed. For example, Japanese Published Unexamined Patent Application No. Sho 54-51837 and Japanese Published Unexamined Patent Application No. Sho 54-59139 disclose such an on-demand thermal type ink jet recording apparatus. In the piezoelectric type, the volume of a passage is changed by displacement of a piezoelectric element provided in the passage, ink is jetted from the nozzle head by the pressure and adheres on a recording medium, and an image is formed. For example, Japanese Published Unexamined Patent Application No. Sho 53-12138 and Japanese Published Examined Patent Application No. Sho 53-45698 disclose such an on-demand piezoelectric type ink jet recording apparatus.

In the conventional ink jet system in which ink droplets are jetted from a nozzle or an aperture, ink having low viscosity in a range from 1 mPa·s to 3 mPa·s is used, and ink is jetted from a nozzle or an aperture having a small diameter in a range from 30 $\mu$m to 50 $\mu$m. Because the viscosity of ink is low, the reduction of the ink quantity in the nozzle or aperture due to ink jetting is re-filled at high speed from an ink storage unit. Therefore, because the meniscus (interface between ink and air) in the nozzle head or aperture resumes rapidly, ink jetting is stable even though high speed printing at a repeating jetting frequency exceeding 10 kHz is performed.

However, in the case that low viscosity ink is printed on a normal paper, fast ink penetration causes feathering along fibers of the paper, the feathered image feels rough and results in reduced image quality. When adjacent dots are concatenated due to feathering, the resolution is reduced on that portion, and the image quality is deteriorated severely. Suppression of penetration speed by controlling the surface tension of ink causes inter color bleeding with ink of different color which is jetted on the adjacent spot, also resulting in deteriorated image quality severely.

To solve the above-mentioned problem caused from low viscosity ink, the use of high viscosity ink helps the penetration speed of the ink into a recording medium to be slowed and prevents feathering, and also helps the bleeding speed between different colors to be slowed and prevents bleeding, and the use of high viscosity ink is very effective for solving the above-mentioned problem.

With the extensive diffusion of recording apparatuses using ink jet system, application is widening rapidly, and therefore the wide variety of recording media have been used. It is desired that the ink jet recording system is applied not only to paper but also to various non-water absorptive media such as metals, plastics, and glasses, and it is desired that the ink jet recording apparatus which is capable of using high viscosity and tacky ink is realized.

However, it is difficult for the conventional ink jet system having a nozzle or an aperture to make use of high viscosity ink because the passage resistance is high and the ink supply speed is very low. With an increase of the passage resistance, the energy required to jet ink increases. For example, if an ink jet apparatus which normally uses commercially available water color ink (having a viscosity in a range from 1 mPa·s to 3 mPa·s) uses high viscosity ink, the ink supply becomes insufficient if the ink viscosity is higher than 10 mPa·s, and the resumption of meniscus cannot follow the ink consumption. Ink jetting in such state results in scattered ink jetting quantity and jetting direction and results in poor picture quality because ink is jetted from the unstable meniscus position. When ink having a viscosity exceeding 20 mPa·s is used, the ink supply delays from consumption severely, and irregular jetting is caused. Further, when ink having a viscosity exceeding 100 mPa·s is used, even if the supply can follow the consumption, the energy generated from the conventional pressure generation unit to jet the ink is insufficient, the ink is jetted unstably or no ink is jetted.

To solve such a problem, for example, Japanese Published Unexamined Patent Application No. Hei 9-169111 proposes a printer in which a nozzle having a large diameter in a range from 50 $\mu$m to 70 $\mu$m is used to reduce the passage resistance, and high speed printing is realized in spite of using high viscosity ink having a viscosity in a range from 10 mPa·s to 100 mPa·s. In this method, the ink supply delays from the ink consumption and repetition printing frequency decreases unless the larger nozzle diameter corresponding to the incremental ink viscosity is used. However, the larger nozzle diameter results in a relatively increased diameter of jetted ink droplets and results in reduced resolution and poor image quality.

To solve the above-mentioned problem, for example, Japanese Published Unexamined Patent Application No. Sho 62-90257 proposes a method in which solid ink is heated so that the viscosity is reduced to a low viscosity in a range from 5 mPa·s to 10 mPa·s, and the ink is jetted in the same manner as used in a normal ink jet system, the ink is cooled and solidified immediately when the ink adheres on a recording medium, and recording is performed. However, in this method, the head unit should be heated always, such heating results in increased energy consumption. Further, because ink droplets are solidified at the moment when the ink droplets adhere on a recording medium, the ink scarcely penetrates into the recording medium, and such insufficient penetration causes a fixing problem. In addition, ink droplets are solidified in the form of a semisphere, and such a semisphere results in the rough surface of the image. The light is scattered on the image surface, the glossiness of the image is reduced, and the color turbidity of OHP is caused, and therefore this method involves many problems.

Further, for example, Japanese Published Unexamined Patent Application No. Sho 56-4467 proposes a method in which ink is jetted from a nozzle or a slit aperture by attracting the ink electrostatically. This method is advantageous in that the ink supply is significantly independent of ink viscosity because the ink is jetted and supplied simultaneously and the ink droplet diameter is not very dependent on the nozzle diameter or the slit width. However, the high viscosity causes long stringing when the ink is attracted, and it is difficult to form fine dots. Further, satellite drops are generated from the stringing portion, and the image quality becomes very poor. If ink having higher viscosity is used, the cohesion of the ink is larger than the electrostatic attractive force, the printing becomes impossible.

Some ink jet systems having no nozzle have been proposed though they are not commercialized. For example, Japanese Published Unexamined Patent Application No. Sho 51-132036 proposes a method in which many small electric heaters are provided just under an ink level of an ink layer having the depth of 300 $\mu$m, a current is supplied selectively to heaters located at specified positions to form bubbles, the bubbles burst at the ink surface to generate fine droplets of the ink, and the fine droplets are used for recording. In this method, it is considered that low viscosity ink is used, and actually, it was confirmed that an ink droplet jetting phenomenon was observed when low viscosity ink having a viscosity in a range from 1 mPa·s to 3 mPa·s was used.

However, when ink having higher viscosity is used, though the ink is jetted for the ink having a viscosity up to 10 mPa·s, ink droplets split when bubbles burst, fine droplets other than droplets served for recording are scattered to the surrounding areas, so-called misting is caused, and the image quality is deteriorated severely. It is considered that high ink viscosity results in high internal resistance in the ink and prevents bubbles from growing. Based on the ink jetting principle of this method, it is required for the ink thickness to be thick to some degree, but because the internal resistance force depends on the ink thickness, high viscosity ink cannot be used because of increased internal resistance force. In the method, ink is supplied based on the fluidity of the ink, therefore, if the fluidity decreases with an increase of ink viscosity, the ink is not supplied swiftly enough for the ink consumption.

Yet another method, for example, Japanese Published Unexamined Patent Application No. Sho 62-184860 proposes a method in which commercial water color ink having a thickness in a range from 20 $\mu$m to 80 $\mu$m spread on a belt support is conveyed, the ink or support is heated by a laser beam to generate bubbles, and ink droplets are jetted by bursting the bubbles in the same manner as described in the Japanese Published Unexamined Patent Application No. Sho 51-132036. In comparison with the above-mentioned Japanese Published Unexamined Patent Application No. Sho 51-132036, this method is advantageous in that fluctuation of bubble generation position is suppressed and bubble generation efficiency is improved. Further, because ink spread on the support is conveyed continuously in this method, the ink is supplied swiftly enough for the consumption even though high viscosity ink is used.

In this method, commercially available ink is used as the ink, the viscosity of commercially available ink is as low as 1 mPa·s to 3 mPa·s. For example, if ink having a viscosity up to 10 mPa·s is used, the vibration of the ink is transmitted to the surroundings when the ink is jetted. As the result, when the ink corresponding to the adjacent pixel is jetted, the vibration of the ink level due to transmission from the adjacent pixel which is previously jetted affects to cause unstable jetting direction and jetting quantity. In addition, when low viscosity ink is jetted, ink flows onto the blanked portion where the ink is jetted to decrease from the surroundings after the ink is jetted, and the thickness of the ink is uneven when the ink corresponding to the adjacent pixel is jetted and the jetting quantity becomes unstable. Further, as in the case of the above-mentioned Japanese Published Unexamined Patent Application No. Sho 51-132036, ink droplets split into pieces when bubbles burst because of low viscosity, and misting is caused. In addition, because the ink to be jetted receives a tensile force from the peripheral ink when the ink is separated as an ink droplet, a large amount of energy is required to jet the ink. When higher viscosity ink is used, the ink is not jetted though small bubbles are generated.

Yet another method, for example, Japanese Published Unexamined Patent Application No. Sho 61-118273 proposes a method in which ink held on a holding member having many pits for holding ink is conveyed, the ink is heated using a laser beam, and the ink is jetted by the pressure of bubbles generated in the ink. The same method is described in FIG. 5(A) and FIG. 5(B) of the above-mentioned Japanese Published Unexamined Patent Application No. Sho 62-184860. FIG. 25(A) to FIG. 25(E) are diagrams for describing one example of a conventional ink jet recording system having no nozzle. As shown in FIG. 25(A) to FIG. 25(E), the ink held in a pit is in contact with the side wall of the pit, and the contact causes resistance. When a bubble is generated by heating the ink from the bottom of the pit with starting from the state shown in FIG. 25(A), the ink is extruded from the pit as the bubble grows, and then, the ink receives a resistance from the side wall of the pit. As the result, a large amount of energy is required for jetting. Particularly, the higher the ink viscosity is, the larger is the resistance between the ink and the side wall of the pit, and the more energy is required.

Just before the bubble bursts after the bubble grows, the ink is in contact with the pit at the precise image as shown in FIG. 25(C). If there is slight deviation when the bubble bursts, the ink partially remains adherent to a portion of the edge of the pit as shown in FIG. 25(D) and FIG. 25(E), and the jetting direction of the ink droplet is changed due to adherent force of the ink and the image quality becomes poor. Such adhesion of the ink just before jetting depends on the shape of the pit and the surface condition of the holding member on which the pit is formed, and it is impossible to control the jetting direction unless the shape and the surface condition are perfectly uniform.

Though bubbles burst and ink is jetted using ink having the viscosity up to 10 mPa·s, misting is severe.

To solve the above-mentioned feathering and bleeding problem, various methods in which the recording medium and ink characteristics are devised to solve the problem have been proposed. As a method in which the recording medium is devised to solve the problem, for example, Japanese Published Unexamined Patent Application No. Hei 9-207429 proposes a method in which a polymer porous layer is formed on a synthetic paper base, ink is absorbed and held in the polymer porous layer in a moment, in order to solve the above-mentioned problem. As a method in which the ink characteristics is devised to solve the problem, for example, Japanese Published Unexamined Patent Application No. Hei 8-281932 proposes a method in which plural kinds of ink having different properties are used, chemical reaction is caused by contact of the plural kinds of ink having different properties, they are fixed in a moment, in order to solve the above-mentioned problem.

However, the method in which the recording medium is devised results in high cost of the recording medium itself, the recording medium is limited to the special grade dedicated paper, and the method is used only in limited application as the recording system. The method in which the ink characteristics are devised results in high cost of the ink itself, a process which requires plural kinds of ink having different properties is complex, and leads to a large-scale and high cost apparatus.

As described hereinbefore, the conventional ink jet recording technology cannot bring about high speed stable jetting of a small amount of high viscosity ink, therefore, cannot solve the problem of feathering of ink and bleeding between different colors, and cannot realize wide application of ink jetting onto the variety of recording media.

The present invention has been accomplished in view of the above-mentioned problem, the object of the present invention is to provide an image forming method which is capable of stable jetting of a small amount of high viscosity ink at high speed without incremental energy consumption and to realize an image forming apparatus which is capable of forming high quality highly precise images at high speed without feathering on various recording media.

SUMMARY OF THE INVENTION

In the present invention, ink is held on the flat surface of an ink carrier, the ink carrier is partially heated correspondingly to image information. The ink on the interface between the ink carrier and the ink or near the interface is boiled, and the ink is jetted with the pressure of bubbles generated by boiling. At this time, only the bottom surface of the ink is in contact with the ink carrier. When the ink is jetted, the bottom of the ink is separated from the ink carrier with interposition of a bubble generated by heating. Therefore, the resistance due to contact with the ink carrier is not exerted on the ink, and the ink requires only small energy. Because the ink is not in contact with the ink carrier when jetting, jetting direction is stable, and a high quality highly precise image is formed. Because the ink held on the ink carrier is conveyed continuously to the heating position, recording is performed at a speed corresponding to the conveying speed of the ink carrier, the ink is supplied at high speed regardless of ink viscosity, and therefore an image is formed at high speed.

Ink is held in the form of ink droplets or a stripe uniform pattern on the ink carrier. Particularly, in the case of the ink droplet pattern, no resistance force is exerted on the ink to be jetted from the peripheral ink, therefore the ink is jetted stably approximately in the perpendicular direction. Because no resistance force is exerted on the ink from the surroundings, the ink having a viscosity in a wide range from high to low viscosity can be jetted with very small energy, change to some degree in the viscosity hardly influences ink jetting. Further, the influence of ink jetting is not transmitted to the surroundings. Therefore, recording can proceed independently of the surrounding pixels, and a high quality highly precise image is formed at high speed.

Further, in the case of the ink pattern of stripe held on the ink carrier, the ink continues in only two directions, the resistance force exerted from the surroundings is very small, and various properties of the ink are uniform, therefore the ink on the heated area is jetted stably in the perpendicular direction. Because the resistance force exerted from the surroundings is small, the ink having a viscosity ranging from high to low viscosity can be jetted with very small energy, change to some degree in viscosity hardly influences the ink jetting. Therefore, high speed printing is possible, and a high quality highly precise image is formed. In addition, the stripe pattern is advantageous in that ink is spread on the ink carrier using a very simple tool such as a blade having a convex-concave edge.

Because the ink is held on the ink carrier in the form of either pattern and the quantity of ink droplets to be jetted is determined when the ink is spread on the ink carrier in the form of a pattern, the quantity of ink droplets is stable. By minimizing a droplet in the case of the ink droplet pattern or by narrowing a stripe in the case of the stripe pattern, the jetting ink quantity can be reduced and fine dots are reproduced.

Other than the above-mentioned patterns, ink may be held in the form of an even thin layer having a thickness of 20 $\mu$m or less, preferably 10 $\mu$m or less, when the ink is held on the ink carrier. In this case, though the ink to be jetted receives the resistance force such as a tensile force from the ink located on the periphery of the heated area, the resistance force exerted on the ink to be jetted from the surroundings is reduced by forming the ink layer as thin as 20 $\mu$m or less, and properties of the ink is uniform, therefore the ink on the heated area can be jetted stably approximately in the perpendicular direction. Because the resistance force is small, the ink ranging from high viscosity ink to low viscosity ink can be jetted with small energy, and change to some degree in viscosity hardly influences the ink jetting. In addition, the method in which a thin ink layer is formed on the ink carrier can be realized using a very simple tool such as plain blade or roller member, the ink is spread on the ink carrier stably at high speed. By forming a very thin ink layer, the jetting ink quantity can be reduced and fine dots are reproduced.

In the case that ink is held on the ink carrier in the form of thin layer as described hereinabove, the ink can be jetted even though ink having a viscosity of 10 mPa·s or higher is used. After ink jetting, peripheral ink flows from the surroundings onto the blanked area. However, in the case that high viscosity ink is used as described hereinabove, after ink jetting, the peripheral ink flows very slowly because of high viscosity, and when the ink corresponding to the adjacent pixel is jetted, there is little influence. Therefore, a high quality highly precise image is obtained.

When an image is formed on a recording medium using high viscosity ink, the ink penetrates into the recording medium very slowly, and dried before it penetrates, therefore such slow penetration results in the rough surface of an image, and the glossiness of the image is reduced. To solve such a problem, after an image is formed, the recording medium is pressed, for example, to embed the ink into the recording medium or flatten the ink in order to improve the rough surface.

Further, in some cases that ink having very high viscosity is used, recording speed cannot be increased because of slow drying speed. To solve such problem, after an image is formed, the recording medium is further heated, for example, to accelerate drying speed, and thus recording speed is increased.

BRIEF DESCRIPTION OF THE DRAWINGS

FIG. 2 is a schematic structural diagram for illustrating an image forming apparatus for realizing the first embodiment of the image forming method of the present invention.

FIG. 3(A) and FIG. 3(B) are schematic cross sectional views for illustrating one example of an ink supply roller used in the first embodiment of the present invention.

FIG. 4(A) and FIG. 4(B) are schematic cross sectional views for illustrating another example of an ink supply roller used in the first embodiment of the present invention.

FIG. 5(A) and FIG. 5(B) are schematic cross sectional views for illustrating yet another example of an ink supply roller used in the first embodiment of the present invention.

FIG. 6 is a schematic diagram for illustrating further another example of an ink supply roller used in the first embodiment of the present invention.

FIG. 7 is a diagram for illustrating the first example of a method for heating an ink carrier used in the first embodiment of the present invention.

FIG. 20 is a diagram for describing one example of the relation between the ink viscosity and the ink layer thickness when the third embodiment of the image forming method of the present invention and the image forming apparatus used for implementing the third embodiment are used.

DETAILED DESCRIPTION OF THE PREFERRED EMBODIMENTS

Figure 1A:
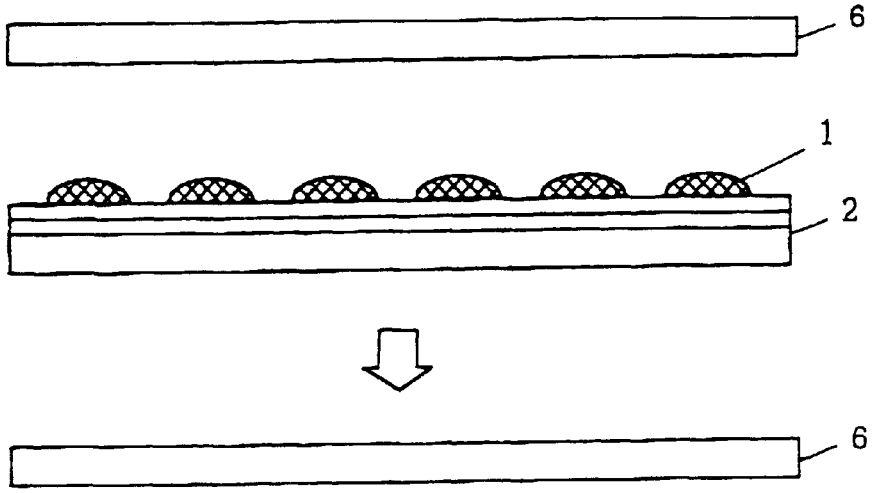
FIG. 1(A) to FIG. 1(D) are diagrams for describing the principle of the first embodiment of the image forming method of the present invention.

FIG. 1(A) to FIG. 1(D) are diagrams for describing the principle of the first embodiment of an image forming method in accordance with the present invention. In this drawing, 1 represents color ink, 2 represents an ink carrier, 3 represents a heating unit, 4 represents an air layer, 5 represents an ink drop, and 6 represents a recording medium. In this first embodiment, as shown in FIG. 1(A), an example is shown in which the color ink 1 is held on the ink carrier 2 in the form of isolated droplets, the ink carrier 2 is heated with the heating unit 3 according to image information, and ink droplets 5 are jetted.

The ink carrier 2 has a flat surface which holds the color ink 1. The ink carrier 2 is structured so that the surface which holds the color ink 1 is heated selectively by external heating or by internal heating. The recording medium 6 is located facing to the surface of the ink carrier 2-on which the color ink 1 is held with interposition of a small clearance.

Figure 1B:
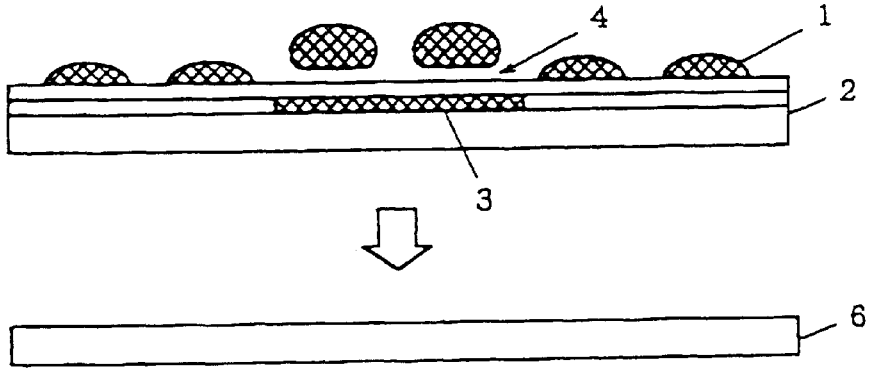
Figure 1C:
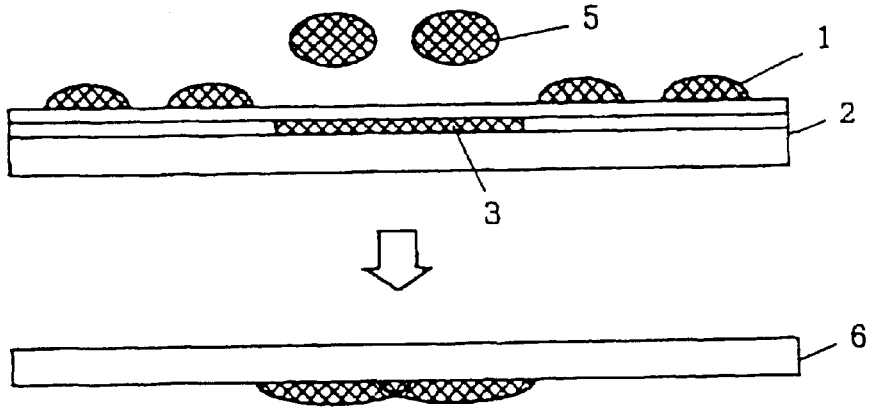
Figure 1D:
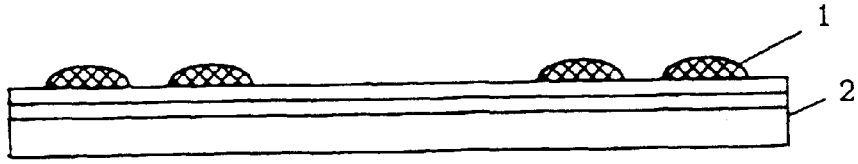

In the state that the color ink 1 is held on the ink carrier 2 in the form of isolated droplets as shown in FIG. 1(A), for example, the heating unit 3 which are hatched as shown in FIG. 1(B) is heated selectively. Alternatively this area of the ink carrier 2 is heated externally. Then, color ink 1 located on the contact interface or near the interface between the isolated color ink 1 droplets and the ink carrier 2 is boiled and evaporated, and an air layer 4 is formed between the ink carrier 2 and the color ink was shown in FIG. 1(B). As the result, adhesion between the ink carrier and the color ink 1 is reduced, and simultaneously droplets 5 are jetted due to rapid volume expansion pressure of the air layer 4. At this time, droplets 5 are jetted in the perpendicular direction consistently because there is nothing which is in contact with the droplets 5 and there is no resistance to disturb the droplets 5. Because of reduced adhesion between the ink carrier 2 and the droplets 5 and no resistance from the surroundings, the ink droplets 5 can be jetted with small energy. The jetted ink droplets 5 adhere on the recording medium 6 as shown in FIG. 1(D), and recording is performed.

The liquid quantity of jetted ink droplet 5 is the liquid quantity of color ink 1 in the form of droplets formed on the ink carrier 2 as shown in FIG. 1(A) Therefore, the liquid quantity of the color ink 1 in the form of ink droplets is controlled at a constant quantity so that recording is performed with consistent liquid droplet quantity. For example, the color ink 1 in the form of ink droplets is formed finely, then the liquid droplet quantity of the ink droplets 5 is reduced, and fine dots are reproduced on the recording medium 6. As the result, a high precision image is formed.

In this example, the color ink 1 of adjacent two dots is jetted simultaneously, however alternatively, the color ink 1 can be jetted in one droplet unit, or the color ink 1 of three or more droplets can be jetted simultaneously. In this example, because the individual color ink 1 in the form of droplets does not receive any influence from the surroundings as described hereinabove and does not exert any influence on the surroundings, it is possible to jet individual color ink 1 in the form of ink droplets respectively at arbitrary timing. Therefore, the color ink 1 located in an area corresponding to many pixels for image information is jetted simultaneously for recording, and alternatively the color ink 1 located in an area corresponding to many pixels for image information is jetted one after another with different timing. High speed image forming is possible by speeding up the feeding speed of the color ink 1.

Further, because resistance due to contact between the color ink 1 and the ink carrier 2 is reduced by the air layer 4 generated with heating as described hereinabove and there is no resistance caused from the surroundings, even if color ink with high viscosity is used as the color ink 1, the incremental resistance due to the high viscosity is negligible, ink droplets 5 are jetted without a problem. Possible viscosity change does not affect ink droplets 5 jetting. According to the first embodiment of the present invention, any color ink having a viscosity ranging from nigh to low viscosity can be jetted for recording without a problem.

Use of high viscosity color ink 1 brings about high quality images because the ink droplets 5 which adhere on the recording medium 6 are dried fast in comparison with penetration into the recording medium 6 and the fast drying speed prevents the ink droplets 5 from feathering and bleeding. Further, when overprinting is performed for gradation expression, the fast drying speed prevents the ink droplets 5 from bleeding due to an increase of the ink droplets quantity. Further, in the case of multi-color forming, similarly, color expression due to overprinting is performed beautifully, coloring is improved due to reduced bleeding, and edge portions are formed clearly.

Further, because recording is performed by jetting ink in this image forming method, a good image is recorded on a recording medium regardless of the roughness of the recording medium 6 unlike, for example, a so-called heat transfer method in which ink is melted and transferred with heating from a film-form ink carrier.

Water color ink which is formed by dispersing dye or pigment in water may be used as the color ink 1. Alternatively to water color ink, liquids having a relatively low boiling point such as hydrocarbon organic solvents and various kinds of alcohol may be used as an ink solvent. However, water ink is preferable in view of safety of vapor and risk of explosion. In the description hereinafter, water ink is used as the color ink 1. In the case that the viscosity is adjusted experimentally, the viscosity is adjusted in a range from 1 mPa·s to 100000 mPa·s by adding a clay mineral such as phyllosilicate or a water soluble polymer such as starch.

FIG. 2 is a schematic structural diagram for illustrating one example of an image forming device for realizing the first embodiment of the image forming method of the present invention. In this drawing, 11 represents an ink supply unit, 12 represents an ink storage unit, 13 represents an ink supply roller, 14 represents a blade, 15 represents a heating unit, and 16 represents a conveyer unit. In this example, a drum member is used as the ink carrier 2. The surface of the drum member is flat, and color ink 1 is held on the flat surface. The ink carrier 2 is rotated and driven by a rotation driving unit not shown in the drawing in the direction of the arrow shown in the drawing.

The ink supply unit 11 is provided with at least the ink storage unit 12 and the ink supply roller 13. Alternatively it may have the blade 14. Color ink 1 is contained in the ink storage unit 12. The ink storage unit 12 may be provided separately from the ink supply unit 11, and color ink may be transferred to the ink supply unit 11. The ink supply roller 13 is rotated in the direction of the arrow shown in the drawing by a rotation driving unit not shown in the drawing or correspondingly to the rotation of the ink carrier 2. The ink supply roller 13 is immersed partially in the ink storage unit 11, and scoops up the color ink 1 from the ink storage unit 12. The ink supply roller 13 is in contact with the ink carrier 2, and spreads the scooped color ink 1 on the ink carrier in the form of numerous isolated ink droplet patterns. The blade 14 scrapes down excessive color ink 1 scooped up by the ink supply roller 13 to control the ink quantity of the color ink 1.

The heating unit 15 heats partially the ink carrier 2 correspondingly to image information to boil the film of the color ink 1 held on the surface and to jet the color ink 1 in the form of droplets. The heating unit 15 heats itself and the heat is transferred to the ink carrier 2 to heat the color ink 1, alternatively, the heating unit 15 does not generate heat and instead the ink carrier 2 may generate heat partially.

The conveyer unit 16 conveys the recording medium 6, and functions as a moving unit for moving the recording medium with facing to the heating unit 15 and holding a small clearance to the ink carrier 2. In this example, an example in which the recording medium is moved is shown, however alternatively, other parts including the heating unit 15 may be moved, further alternatively both elements may be moved, in other words, the heating unit 15 and the recording medium 6 may be moved relatively.

The color ink 1 in the ink storage unit 12 is scooped up by rotation of the ink supply roller 13, and excessive color ink 1 is scraped off using the blade 14. Next, the ink supply roller 13 and the ink carrier 2 are brought into contact, and then, the color ink 1 scooped up by the ink supply roller 12 is transferred onto the ink carrier 2, and isolated-ink droplets of the color ink 1 are formed on the surface of the ink carrier 2. The ink carrier 2 is rotated and the color ink 1 spread in the form of isolated ink droplets is transferred to the heating unit 15. On the other hand, the recording medium 6 is conveyed by the conveyer unit 16 holding a small clearance to the ink carrier 2. The color ink 1 moved to the position facing to the recording medium 6 is heated by the heating unit 15 according to image information, ink droplets 5 are jetted onto the recording medium 6 as shown in FIG. 1(A) to FIG. 1(D), and the ink droplets 5 adhere on the recording medium 6. Continuously the ink carrier 2 is rotated, and new color ink 1 is moved to the position above the heating unit 15, thereby the next ink droplets 5 are jetted. By performing recording operation with moving the recording medium 6 using the conveyer unit 16, a two-dimensional image is formed.

The color ink 1 which is held on the ink carrier 2 but is not jetted is squeezed when the ink supply roller 13 and the ink carrier 2 are brought into contact again with rotation of the ink carrier 2, and retrieved in the ink storage unit 11. Alternatively, a scraper may be provided to scrape the color ink 1 on the ink carrier 2.

Next, detailed examples of each member shown in FIG. 2 is described. FIG. 3(A) and FIG. 3(B) to FIG. 5(A) and FIG. 5(B) are schematic cross-sectional views for illustrating one example of the ink supply roller to be used in the first embodiment of the present invention. Each FIG. (B) is a partially enlarged view. In the drawings, 21 represents a pit, 22 represents a though hole, 23 represents a mesh film, and 24 represents an elastic member.

On the surface of the ink supply roller 13 shown in FIG. 3(A) and FIG. 3(B), numerous pits 21 having a diameter of 10 $\mu$m to 200 $\mu$m and a depth of 1 $\mu$m to 50 $\mu$m are formed with a uniform pitch. As the material used for the ink supply roller 13, roller material including materials such as rubber, resin, plastic, and metal may be used. The pits 21 may be formed by embossing, laser processing, or etching respectively to corresponding roller material. At least a material which has elastic surface is used preferably as the material of the ink supply roller 13 in order to ensure consistent contact with the ink carrier 2. The elastic property allows the contact pressure exerted on the ink carrier 2 to squeeze out of the shape of the pits 21, the color ink 1 held in the pits 21 is brought into contact with the ink carrier 2 consistently, and transfer failure is prevented.

Along with rotation of the ink supply roller 13, the color ink 1 is supplied to the pits 21 in the ink storage unit 12. Then, though the color ink 1 adheres on the area other than the pits 21 on the surface of the ink supply roller 13, the excessive color ink 1 on the ink supply roller 13 is squeezed off at the position of the contact with the ink carrier 2, and retrieved in the ink storage unit 11. In the structure which is provided with the blade 14, the color ink 1 is scooped up by the ink supply roller 13, the color ink 1 is pushed into the pits 21 by the blade 14 before being transferred onto the ink carrier 2, and the excessive color ink 1 is scraped. Thereby, the color ink 1 can be supplied to the pits 21 of the supply roller 13 consistently.

In the example of the ink supply roller 13 shown in FIG. 4(A) to FIG. 4(D), an example in which a hollow cylinder member provided with though holes 22 is used is shown. In this case, when the ink supply roller 13 is immersed in the ink storage unit 12 and subsequently draw up, the through holes 22 are filled with the color ink 1 due to capillary force. Subsequently, by pressing the ink supply roller 13 onto the ink carrier 2, the color ink 1 in the through holes 22 can be transferred onto the ink carrier 2. Of course, excessive color ink 1 can be removed by the blade before contact with the ink carrier 2.

The ink supply roller 13 shown in FIG. 5(A) and FIG. 5(B) is a roller which is formed by covering a roll-shaped elastic member 24 consisting of porous material with mesh film 23 having numerous through holes 22. The ink supply roller 13 is immersed in the ink storage unit 12 so that the elastic member 24 is impregnated with the color ink 1. The mesh film 23 does not absorb the color ink 1. The ink supply roller 13 impregnated with the color ink 1 is pressed onto the ink carrier 2, the color ink 1 impregnated and held in the elastic member 24 is thereby squeezed out from the through holes 22 of the mesh film 23, and transferred onto the ink carrier 2.

FIG. 6 is a schematic diagram for illustrating another example of an ink supply roller used in the first embodiment of the present invention. In the drawing, 25 represents a hydrophilic pattern. On the ink supply roller 13 shown in FIG. 6, a hydrophilic pattern and a hydrophobic pattern are formed on the surface. For example, a layer of silicone-based water repellent material or fluorine-based water repellent material is formed on the surface of a roll base made of aluminum, and a laser beam is radiated onto the surface to remove partially the water repellent surface layer, and the desired hydrophilic pattern 25 is thereby formed. The size and pattern of ink droplets to be formed can be controlled by adjusting the area and disposition of the hydrophilic pattern 25.

Examples of the water repellent surface layer consisting of silicone-based water repellent material include film of silicone-based releasing agent, based film of silicone oil or various modified silicone oils, film of silicone varnish, film of silicone rubber, and film of composite materials of silicone rubber containing various metals, rubbers, plastics, and ceramics. Examples of the water repellent surface layer consisting of fluorine-based water repellent material include film of fluorine contained resin, film of organo-fluorine compound, baked film or adsorption film of fluorine oil, film of fluoro rubber, and film of composite materials of fluoro rubber containing various metals, rubbers, plastics, and ceramics.

The water repellent surface (hydrophobic surface) is the surface having a contact angle with the color ink 1 of at least 90 degrees or greater, preferably 120 degrees or greater.

When the ink supply roller 13 shown in FIG. 6 is immersed partially in the ink storage unit 12 and the ink supply roller 13 is rotated, the color ink 1 in the ink storage 12 which adheres on the hydrophilic portion of the surface of the ink supply roller 13 is scooped up, excessive color ink 1 and color ink 1 adhering particularly on the water repellent portion are scraped off by the blade 14, the color ink 1 in the form of isolated ink droplets is formed on the ink supply roller 13.

The size of ink droplets formed on the ink supply roller 13 is controlled by adjusting the viscosity of the color ink 1, or by adjusting the size of the hydrophilic pattern, and alternatively by adjusting the pressing force for pressing, for example, the blade 14. For example, by adjusting the pressing force for pressing in a range from 1 g/cm to 50 g/cm, the diameter of the ink droplets can be changed in a range from 5 $\mu$m to 100 $\mu$m correspondingly. The higher the water repellent property of the blade 14 is, the less of the color ink 1 is left on the water repellent portion of the ink supply roller 13. Therefore, for example, a polyurethane blade coated with silicone film may be preferably used as the blade 14.

The ink droplets formed and held on the hydrophilic pattern on the ink supply roller 13 as described hereinabove is transferred onto the ink carrier 2 at the position of the contact with the ink carrier 2, and the color ink 1 is held on the surface of the ink carrier 2 in the form of an isolated ink droplet pattern.

In the case that the ink supply roller 13 shown in FIG. 6 is used, because if the color ink 1 having-excessively high viscosity is used, then it takes a long time for the color ink to be stabilized as ink droplets on the hydrophilic portion after passing through the blade 14, ink having a relatively low viscosity (up to 100 mPa·s ) is preferably used.

In this embodiment, an example in which a hydrophilic pattern 25 and a hydrophobic pattern are formed on the ink supply roller 13 as shown in FIG. 6 is described, however alternatively, a hydrophilic pattern 25 and a hydrophobic pattern are formed on the ink carrier 2, the elastic ink supply roller 13 on which a water repellent surface layer is formed is brought into contact with the ink carrier 2 to form a pattern of ink droplets of the color ink 1 directly on the hydrophilic portion of the ink carrier 2. In this case, the structure of the ink supply roller 13 can be simplified. It is required that the hydrophilic pattern 25 and the hydrophobic pattern are processed so as not to be deteriorated due to heating because the ink carrier 2 is heated by the heating unit 15.

In the above-mentioned example, an example in which the ink supply roller 13 is immersed in the ink storage unit 12 is shown, however alternatively, for example, an ink supply method in which the ink in the ink storage unit 12 is extruded from a slit-shaped aperture and spread on the ink supply roller 13, and other various ink supply methods may be used.

Next, detailed examples of heating methods for heating the color ink 1 by the heating unit 15 are described. The heating unit 15 is structured with, for example, a heating head. The ink carrier 2 having a thin wall thickness is used, and a heating head is provided in contact with the back side of the ink carrier 2. The heating head is heated correspondingly to image information to heat the ink carrier 2, and further to heat the color ink 1.

However, because of the mechanical strength of the material, the thinning of the wall thickness of the ink carrier 2 is limited, and even if a material having a high thermal conductivity is used, widening of heated area and reduction of thermal efficiency due to heat diffusion and heat dissipation are significant.

To avoid the above-mentioned problem, a mechanism which generates heat actually is incorporated in the ink carrier 2, and the heating unit 15 functions to supply generated energy to the ink carrier 2. FIG. 7 is a diagram for illustrating the first example of a heating method for heating the ink carrier in the first embodiment of the present invention. In the drawing, 31 represents an insulating base, 32 represents a conductive pin, 33 represents a support, 34 represents a heat generating resistance layer, 35 represents a conductive layer, 36 represents a friction protection layer, 37 represents a recording electrode, 38 represents a recording head, and 39 represents a heat generation unit. As shown in FIG. 7 as the ink carrier 2, the support 33 which is formed by embedding conductive pins 32, each of which comprises a conductive thin pin member having a diameter of 10 $\mu$m to 200 $\mu$m in the depth direction isolatedly, into the insulating base 31 having electrical insulation is used. On the surface, the heat generation resistance layer 34, the conductive layer 35, and the friction protection layer 36 are laminated one on another, and the laminated structure forms the ink carrier 2.

As a material used for the heat generation resistance layer 34, tantalum-$SiO_2$ mixture, tantalum nitride, nichrome, silver-palladium alloy, silicon semiconductor, or oxide of metals such as hafnium, lantern, zirconium, titanium, tantalum, tungsten, molybdenum, niobium, chromium, and vanadium may be used. The heat generation resistance layer 34 is formed by an electron beam method, an evaporation method, or a spattering method using these materials. The film thickness is designed so that heat generation per unit time is adjusted to a desired value, usually the film thickness is in a range from 0.01 $\mu$m to 5 $\mu$m.

As the material of the conductive layer 35, usual electrode material excellent in heat resistance having a volume specific resistance value of $10^2$ Ω·cm or smaller may be used. For example, a metal electrode material such as Al, Au, Ag, Pt, and Cu may be used. The conductive layer 35 having a thickness of 5 $\mu$m or less may be formed by evaporating these materials.

As the material of the friction protection layer 36, silicone oxide, silicone nitride, magnesium oxide, aluminum oxide, tantalum oxide, and zirconium oxide may be used in view of mechanical strength and heat resistance. The friction protection layer 36 may be formed by an electron beam method, an evaporation method, or a spattering method using these materials. The film thickness is 5 $\mu$m or less, preferably 1 $\mu$m or less in view of mechanical strength and heat efficiency.

The ink carrier 2 as described hereinabove is used, the recording head 38 comprising recording electrodes 37 arranged so as to obtain a desired resolution, which recording head 38 functions as the heating unit 15, is located in contact with the support side of the ink carrier 2, a current is supplied from the recording electrodes 37 to the heat generation resistance layer 34 and the conductive layer 35 through the conductive pin 32 of the support 33 according to image information, and the heat generation resistance layer 34 thereby generates heat. The heat generation area of the heat generation portion 39 is roughly equal to the approximate diameter of the conductive pin 32 where the current density is high. Heat generated from the heat generation portion 39 of the heat generation resistance layer 34 is transmitted to the color ink 1 through the conductive layer 35 and the friction protection layer 36.

Figure 8:
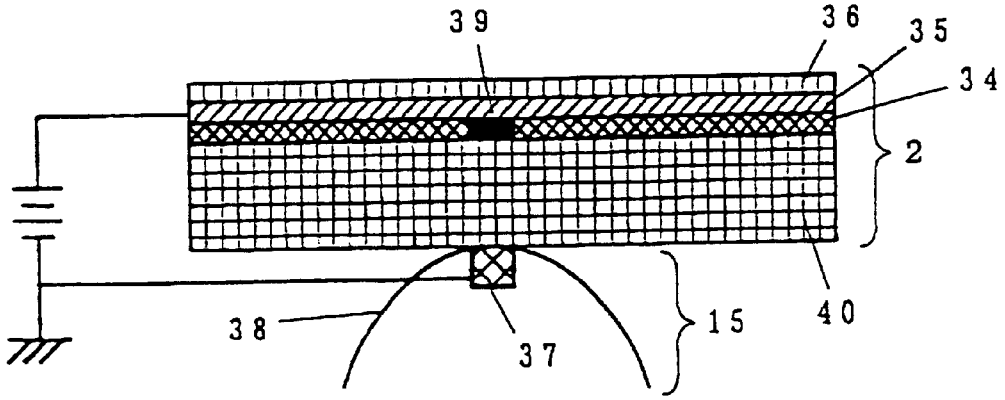
FIG. 8 is a diagram for illustrating the second example of a method for heating an ink carrier used in the first embodiment of the present invention.

FIG. 8 is a diagram for illustrating the second example of a method for heating the ink carrier in the first embodiment of the present invention. In the drawing, the same numbers are given to the same components as shown in FIG. 7, and a description will be omitted. 40 represents a semiconductor support. In this example, the semiconductor support 40 consisting of semiconductor material having the resistance value which changes correspondingly to the electric field is used as the support 33, and the ink carrier 2 is structured by laminating the heat generation resistance layer 34, the conductive layer 35, and the friction protection layer 36 one on another on the surface of the semiconductor support The material used for the semiconductor support 40 having the resistance value which changes correspondingly to the electric field may be selected from materials containing polyvinyl chloride, polyethylene, polyimide, and Teflon as the base. These materials have the specific resistance of $10^{14}$ Ω·cm or higher without electric field, but the specific resistance changes to $10^4$ Ω·cm or lower in an electric field ranging from $10^5$ V/m to $10^6$ V/cm. Among these materials, polyimide and Teflon are used preferably in view of heat resistance.

The ink carrier 2 as described hereinabove is used, the recording head 38 comprising recording electrodes 37 arranged so as to obtain a desired resolution, which recording head 38 functions as the heating unit 15, is located in contact with the support side of the ink carrier 2, an electric field is applied from the recording electrodes 37 according to image information to reduce the resistivity of the semiconductor support 40, and a current is supplied thereby from the recording electrodes 37 through reduced resistance portion of the semiconductor support 40, the heat generation resistance layer 34, and the conductive layer 35, and thus the heat generation resistance layer 34 generates heat. The area of the heat generation portion 39 is approximately the size of the recording electrode 37 where the electric field is strong. At a position distant from this area, the electric field is weak in the semiconductor support 40, which results in high resistance and low current. Accordingly, the heat generation portion 39 of the heat generation resistance layer 34 generates heat selectively. Heat generated from the heat generation portion 39 of the heat generation resistance layer 34 is transmitted to the color ink 1 through the conductive layer 35 and the friction protection layer 36.

Figure 9:
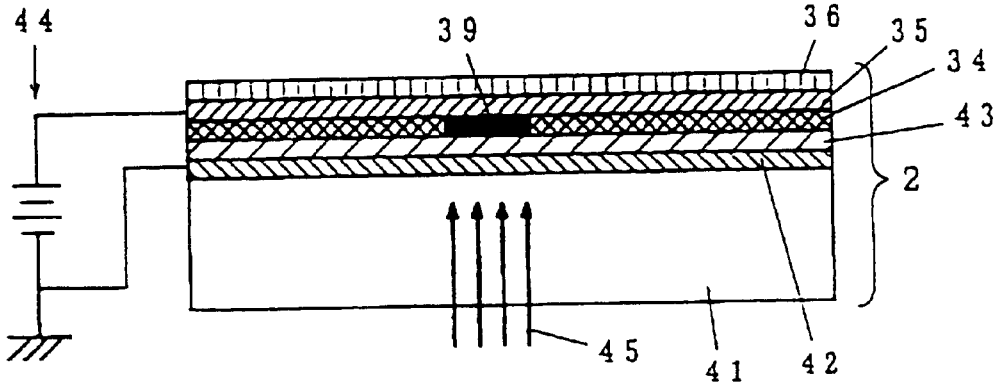
FIG. 9 is a diagram for illustrating the third example of a method for heating an ink carrier used in the first embodiment of the present invention.

FIG. 9 is a diagram for illustrating the third example of a method for heating the ink carrier in the first embodiment of the present invention. In the drawing, the same numbers are given to the same components as shown in FIG. 7, and a description is omitted. 41 represents a transparent support, 42 represents a transparent conductive layer, 43 represents an optical conduction layer, 44 represents a bias electric source, and 45 represents LED light. In this example, the ink carrier 2 which is formed by laminating the transparent conductive layer 42, the optical conduction layer 43, the heat generation resistance layer 34, the conductive layer 35, and the friction protection layer 36 one on another on the transparent support 41 is used. In this case, a constant bias voltage is applied to the transparent conductive layer 42 and the conductive layer 35 from the bias electric source 44.

As the material used for the transparent support 41, various glasses containing silicone oxide as the main component, inorganic materials such as boron fluoride, and transparent heat resistant plastics may be used in view of light transmittance and heat resistance. As the material used for the transparent conductive layer 42, a single layer of metal materials such as indium oxide, tin oxide, chromium oxide, and polyacetylene or a mixed layer of such various metal materials may be used in view of light transmittance and heat resistance. The thickness may be preferably 5 $\mu$m or less in view of light transmittance. As the material used for the optical conduction layer 43, metals such as selenium, silicon, sulfur, cadmium sulfide, and zinc oxide or alloys containing such metals, and coloring materials such as phthalocyanine-based and perylene-based compounds may be used, however, a silicon-based optical conduction layer is preferably used in view of heat resistance. Thickness is preferably in a range from 0.1 $\mu$m to 5 $\mu$m.

The ink carrier 2 as described hereinabove is used, a light emission unit not shown in the drawing which emits light having a wavelength to be absorbed by the optical conduction layer 43 is located in contact with the support side of the ink carrier 2, in this structure the light emitting unit is used as the heating unit 15, and the optical conduction layer 43 is radiated with the light according to image information. For example, an LED array is used as the light emitting unit, and the LED light is radiated from the transparent support 41 side. A portion of the optical conduction layer 43 where the light is radiated is made conductive, a current is supplied through the transparent conductive layer 42, the optical conduction layer 43, the heat generation resistance layer 34, and the conductive layer 35, and the heat generation layer 34 generates heat.

As the light emitting unit other than the LED array, lasers, liquid crystal shutter arrays, and slit exposure devices may be used. Particularly the LED array is preferably used because the LED array can be minimized in size and an LED head can be disposed in the ink carrier 2. Therefore, the apparatus can be minimized in size.

Figure 10:
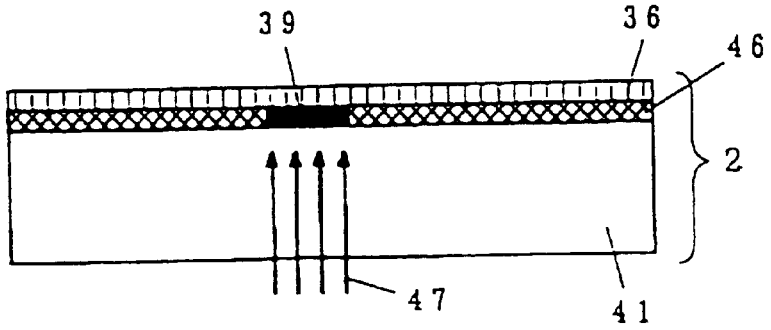
FIG. 10 is a diagram for illustrating the fourth example of a method for heating an ink carrier used in the first embodiment of the present invention.

FIG. 10 is a diagram for illustrating the fourth example of a method for heating the ink carrier in the first embodiment of the present invention. In the drawing, the same components as shown in FIG. 7 to FIG. 9 are given the same characters, and description is omitted. 46 represents a light absorption heat generation layer and 47 represents a laser beam. In this example, a structure formed by laminating the light absorption heat generation layer 46 and the friction protection layer 36 one on the other on the transparent support 41 is used as the ink carrier 2 as shown in FIG. 10. As the material used for the light absorption heat generation layer 46, heat resistant materials which absorb light having a wavelength emitted from the used light emitting unit or heat resistant materials containing a colorant which absorbs light having a wavelength emitted from the used laser may be used. For example, an Al evaporation film and films of inorganic materials such as various glasses containing silicon oxide as the main component and boron fluoride in which a colorant is dispersed may be used.

The ink carrier 2 as described hereinabove is used, the light emitting unit not shown in the drawing is located in contact with the support side of the ink carrier 2, which light emitting unit is used as the heating unit 15, and the light absorption heat generation layer 46 is irradiated with the light according to image information. For example, the laser beam 47 is radiated onto the light absorption heat generation layer 46, and thus a heat generation portion 39 of the light absorption heat generation layer 46 where the laser beam 47 is radiated generates heat.

In this method, a high output light emitting unit is required because all the consumed heat energy should be converted from light energy. For example, various lasers such as argon laser, helium laser, carbon dioxide laser, and semiconductor laser may be used. However, a semiconductor laser may be used preferably in view of minimization and cost reduction of the apparatus. In detail, a semiconductor laser having an output of 30 mW may be used.

Figure 11:
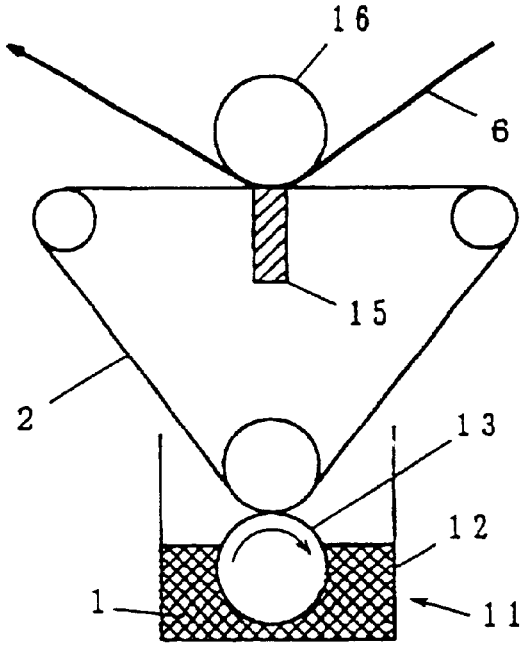
FIG. 11 is a schematic structural diagram for illustrating the first modified example of an image forming apparatus used for implementing the first embodiment of the image forming method of the present invention.

FIG. 11 is a schematic structural diagram for illustrating the first modified example of an image forming apparatus for implementing the first embodiment of the image forming method of the present invention. In the drawing, the same components as described in FIG. 2 are given the same numbers, and a redundant description is omitted. In this modified example, an example in which a belt-shaped ink carrier 2 is used is shown. As the belt-shaped ink carrier 2 and the heating unit 15, either structure shown in FIG. 8 or FIG. 10 described hereinbefore may be used. By structuring the ink carrier 2 in the form of belt, the thickness of the ink carrier 2 can be thinned, therefore a structure in which a heating head is-used as the heating unit 15 and the heating head is located in contact with the back side of the ink carrier 2 for heating may be applied. As the belt having high heat conductivity and mechanical strength, for example, a metal belt consisting of, for example, stainless steel is used. The thickness of the belt is 50 $\mu$m or less, preferably 20 $\mu$m or less in view of heat dissipation. The structure of the ink supply unit 11 may be any one of the same structures described in the above-mentioned examples.

In the case that the belt ink carrier 2 is used, because the area of the surfaces of the recording medium 6 and the ink carrier 2 which are located in parallel is large, the heating unit 15 is arranged two-dimensionally, then it is possible to record simultaneously on a wide area. Of course, it is possible to record on the entire area of a recording medium 6 simultaneously.

Figure 12:
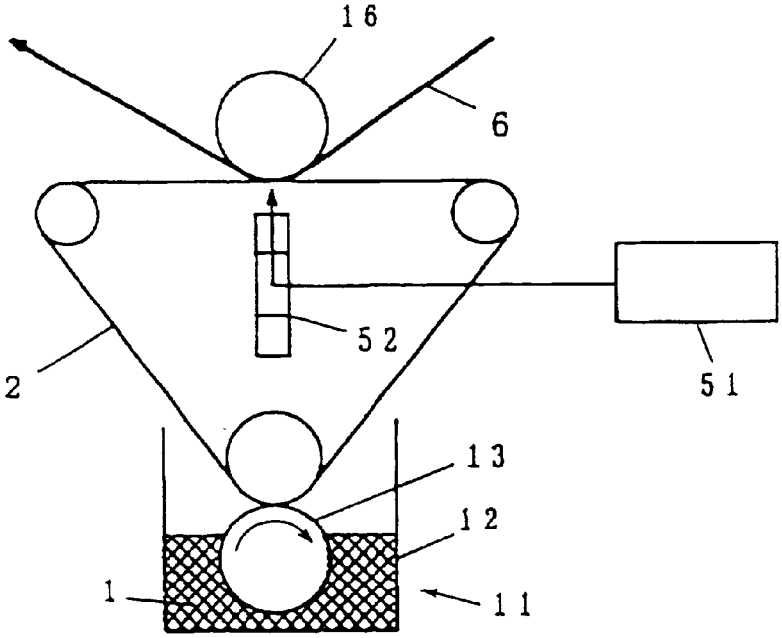
FIG. 12 is a schematic structural diagram for illustrating the second modified example of an image forming apparatus used for implementing the first embodiment of the image forming method of the present invention.

FIG. 12 is a schematic structural diagram for illustrating the second modified example of an image forming apparatus for implementing the first embodiment of the image forming method of the present invention. In the drawing, the same components as described in FIG. 11 are given the same numbers, and a redundant description is omitted. 51 represents a semiconductor laser and 52 represents a laser scanning device. It is difficult to contain various components including the semiconductor laser 51 for generating the laser beam 47 and the laser scanning device 52 for scanning the laser beam in the drum-shaped ink carrier 2 in a structure in which heat is generated using the laser beam 47 like the structure of the ink carrier 2 and the heating unit 15 shown in FIG. 10 described hereinabove. To solve this problem, space efficiency is improved by use of the belt ink carrier 2 as in the case of the first modified example shown in FIG. 11. In this case, a structure which has the light absorption heat generation layer 46 as shown in FIG. 10 is used as the belt ink carrier 2. Any one of the structures shown in the above-mentioned examples may be used as the structure of the ink supply unit 11.

Figure 13:
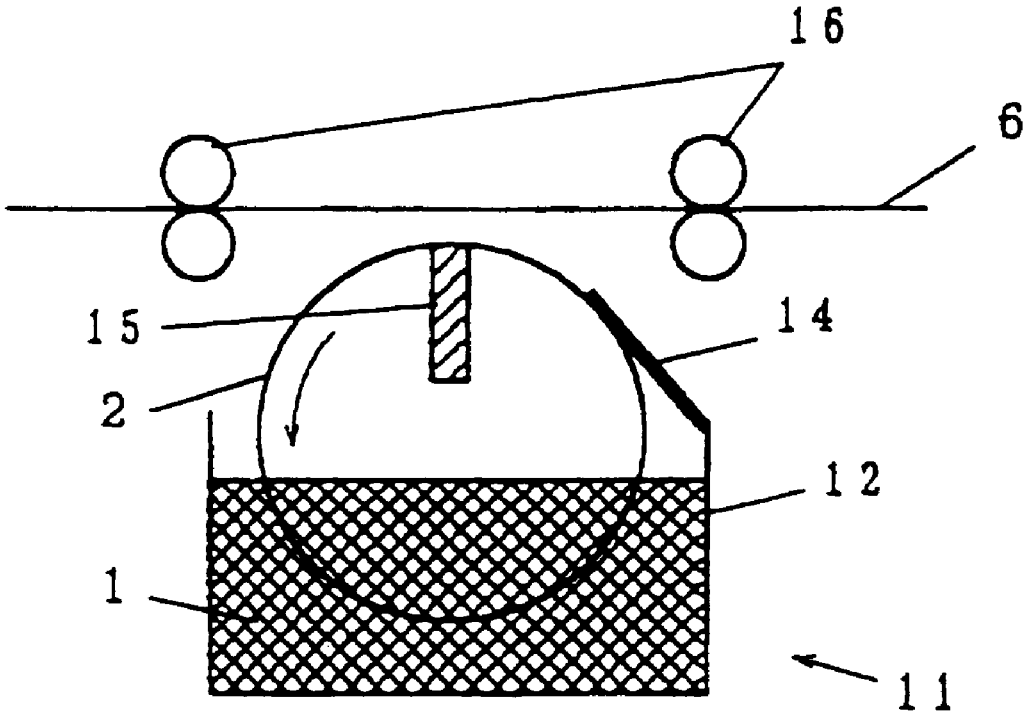
FIG. 13 is a schematic structural diagram for illustrating the third modified example of an image forming apparatus used for implementing the first embodiment of the image forming method of the present invention.

FIG. 13 is a schematic structural diagram for illustrating the third modified example of an image forming apparatus for realizing the first embodiment of the image forming method of the present invention. In the drawing, the same components as described in FIG. 2 are given the same numbers, and a redundant description is omitted. In this example, an ink supply roller is not used, and an example in which the ink carrier 2 is immersed in the ink storage unit 12 is shown. In this case, on the surface of the ink carrier 2, the same hydrophilic pattern as the pattern formed on the surface of the ink supply roller 13 shown, for example, in FIG. 6 is formed. The ink carrier 2 is immersed in the ink storage unit 12, thereafter the adhering color ink 1 is scraped off using the blade 14 having a water repellent surface layer, and thereby a pattern of the color ink 1 in the form of ink droplets is formed directly on the hydrophilic portion of the ink carrier 2. Any heating method described hereinbefore may be used as the heating method. The belt ink carrier 2 as described in FIG. 11 and FIG. 12 may be used.

Color ink jetting is observed using the image forming method described in the first embodiment of the present invention and the image forming apparatus for implementing the first embodiment and using various color ink having the viscosity ranging from 1 mPa·s to 100000 mPa·s. As the result, the printing energy required to jet one droplet of color ink is several tens $\mu$J in the conventional ink jet system which utilizes heat, on the other hand, the jetting energy is 10 $\mu$J or less in the first embodiment of the present invention, it is found that color ink can be jetted with very small printing energy. Accordingly, the present invention provides an energy saving image forming apparatus, and the internal electric circuit is minimized and the apparatus structure is minimized. The quantity of heat required to jet color ink is reduced, therefore thermal impact on the environment is reduced, ink droplets are jetted stably, and a high quality image is obtained.

Further, the printing energy is independent of the viscosity of color ink, and color ink having a viscosity of as high as 100000 mPa·s can be jetted without a problem. Color ink having high viscosity can be used, resulting in reduction of feathering and bleeding, and it is possible to obtain a high quality image.

By forming the color ink pattern in the form of fine ink droplets on the ink carrier 2, very small dots (20 $\mu$m is observed) are formed in comparison with the dot (50 $\mu$m or larger) in the conventional ink jet method. Therefore a highly precise image can be formed.

The response speed is high because the generation of the air layer 4 between the color ink in the form of ink droplets and the ink carrier 2 generates directly jetting energy for jetting ink droplets, and it is found that the response speed is 40 kHz or higher. High viscosity does not influence the supply speed of the color ink 1 because the color ink 1 is fed and supplied continuously by the ink carrier 2, therefore high speed operation of the ink carrier 2 brings about high speed supply. In the experiment, it is confirmed that the color ink 1 is supplied at a moving speed of 1 m/sec or higher, this moving speed is equivalent to the supply speed in printing frequency of 20 kHz or higher for printing of 600 dpi resolution. Color ink is supplied and jetted at high speed as described hereinabove, therefore it is possible to record at high speed in comparison with the conventional ink jet recording system.

FIG. 14(A) to FIG. 14(D) are diagrams for describing the principle of the second embodiment of the image forming method of the present invention. Numbers shown in the drawing are the same as shown in FIG. 1(A) to FIG. 1(D). For the second embodiment, an example is shown in which the color ink 1 is held in the form of stripe on the ink carrier 2, the ink carrier 2 is heated with the heating unit 3 according to image information, and ink droplets 5 are jetted. In FIG. 14(A) to FIG. 14(D), a cross-section in the extending direction of the stripe color ink 1 is shown. The width of the stripe is approximately equal to the diameter of the pattern in the form of ink droplets in the above-mentioned first embodiment, the cross-section in the direction orthogonal to the stripe is the same as that shown in FIG. 1(A) to FIG. 1(D).

Figure 14A:
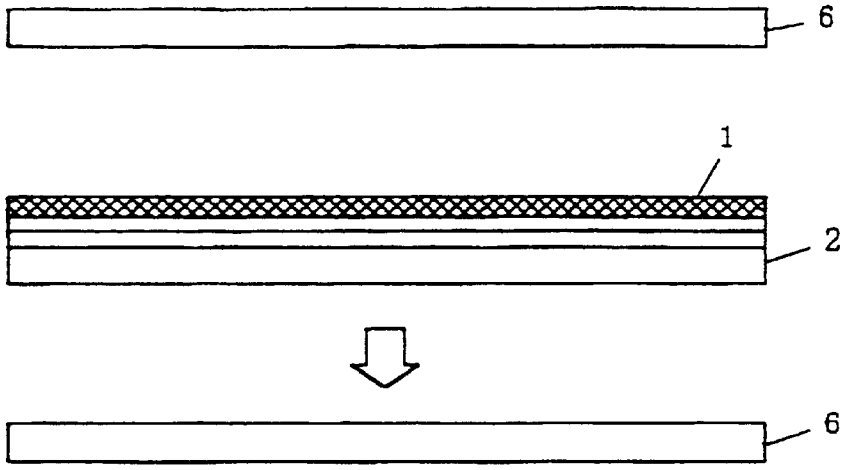
FIG. 14(A) to FIG. 14(D) are diagrams for describing the principle of the second embodiment of the image forming method of the present invention.
Figure 14B:
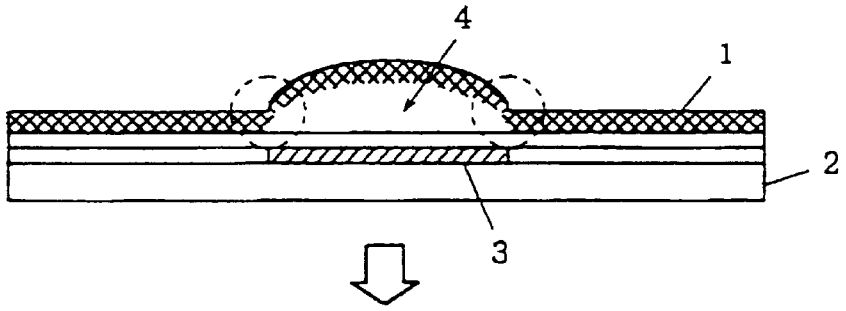
Figure 14C:
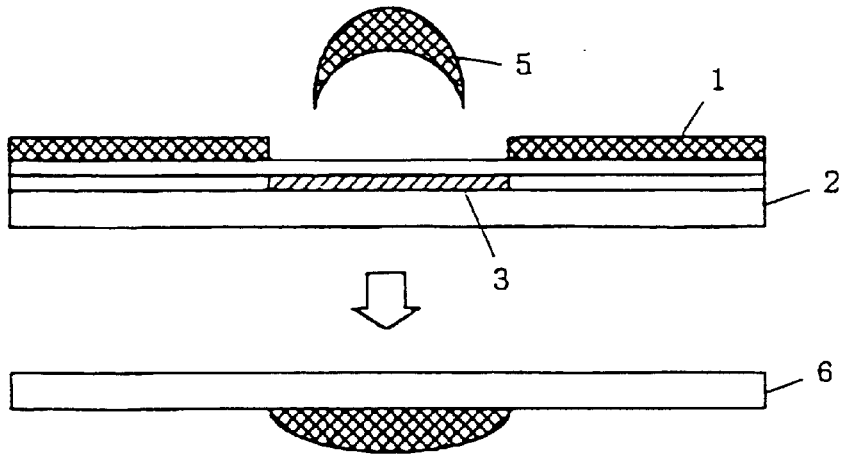
Figure 14D:
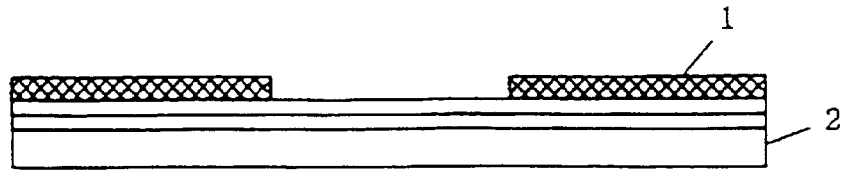

The color ink 1 is held on the ink carrier 2 in the form of a stripe pattern. The color ink 1 is continuous in the extending direction of the stripe as shown in FIG. 14(A). In this state, for example, an area of the heating unit 3 which is hatched in FIG. 14(B) is allowed to generate heat selectively. Alternatively, this area of the ink carrier 2 is heated from the external. Then, the color ink 1 located on the heating unit 3 and the color ink 1 on the interface with the ink carrier 2 or its is boiled and evaporated to generate the air layer 4 between the ink carrier 2 and the color ink 1 as shown in FIG. 14(B). Adhesion between the ink carrier 2 and the color ink 1 is thereby reduced. In this state, the color ink 1 on the air layer 4 is in contact with the color ink 1 on the area other than the heating unit 3 which is continuous in the two directions in the form of stripe. As the result, the color ink 1 on the air layer 4 receives resistance force such as tension at the contact portions shown with broken lines in FIG. 14(B). The resistance forces are exerted only in two directions and are very small, the contact portions are broken due to rapid volume expansion pressure of the air layer 4, and then ink droplet 5 is jetted as shown in FIG. 14(C). At this time, because only the color ink 1 on the area other than the heating unit 3 is in contact and properties of the color ink 1 are uniform, the color ink 1 on the heating unit 3 is jetted in the perpendicular direction in the form of ink droplets 5 stably. Because resistance force received from the peripheral color ink 1 and the ink carrier 2 is small, the ink droplets 5 can be jetted with very small energy. The jetted ink droplets 5 adhere on a recording medium 6 as shown in FIG. 14(D) and recording is performed.

Liquid quantity of ink droplets 5 which are jetted when recording is performed is dependant on the width of the stripe and the length of the heating unit 3. The width of the stripe can be controlled so as to be constant when the color ink is held on the ink carrier, and the length of the heating unit 3 is not changed, therefore recording is performed with a stable liquid droplet quantity. For example, thin stripes are formed, the liquid quantity of the ink droplets 5 is thereby reduced, and fine dots are reproduced on a recording medium 6. A very precise image can be thereby formed. Such a stripe pattern is advantageous in that it is formed with a vary simple method using, for example, a blade having the jagged top edge.

The air layer 4 generated by heating as described hereinabove causes the resistance force due to contact between the color ink 1 and ink carrier 2 to be weakened and additionally the resistance received from the surroundings is small, therefore even though ink having high viscosity is used as the color ink 1, the incremental resistance force due to high viscosity is small, and the ink droplets are jetted without a problem. Change in viscosity does not cause any influence on jetting of the ink droplets 5. As described hereinabove, in the second embodiment of the present invention, the ink droplets 5 are jetted stably for recording with using any ink having the viscosity ranging from high to low viscosity. Use of high viscosity color ink 1 is advantageous in that generation of feathering and bleeding is suppressed and a high quality image is formed.

As a structure of an image forming apparatus to implement the second embodiment of the image forming method of the present invention, the same structure as those shown in, for example, FIG. 2, FIG. 11 to FIG. 13 may be applied. The only difference is the pattern of the color ink 1 formed on the ink carrier 2.

Figure 15:
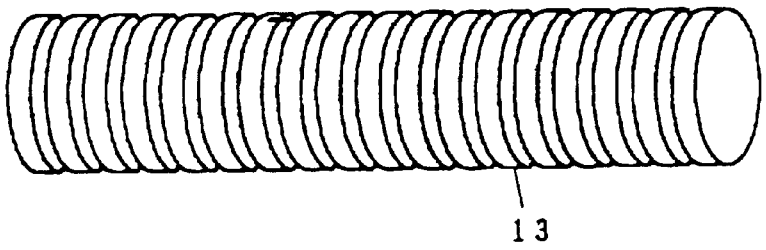
FIG. 15 is a schematic perspective view for illustrating one example of an ink supply roller used in the second embodiment of the present invention.

FIG. 15 is a perspective view for illustrating one example of the ink supply roller to be used in the second embodiment of the present invention. As a detailed method for forming a stripe pattern of the color ink 1 on the ink carrier 2, for example as shown in FIG. 15, a roller member provided with concentric grooves having a desired width, depth, and pitch shown in FIG. 15 is used as the ink supply roller 13. The ink supply roller 13 which is elastic at least on the surface is preferably used because the ink supply roller 13 is brought into contact with the ink carrier 2 to transfer the color ink 1. The width of the grooves may be 5 μm to 200 μm, and the depth may be 5 μm to 50 μm.

The ink supply roller 13 is immersed partially in the ink storage unit 12, and the color ink 1 is supplied in the grooves of the ink supply roller 13. With rotation of the ink supply roller 13, the color ink 1 in the grooves is scooped up, the color ink 1 held in the grooves of the ink supply roller 13 is transferred onto the ink carrier 2 at the position of the contact with the ink carrier 2, and the stripe pattern of the color ink 1 is formed on the surface of the ink carrier 2.

Excessive color ink 1 adhering on the surface of the ink supply roller 13 is squeezed off at the position of the contact with the ink carrier 2, and retrieved in the ink storage unit 12. The color ink 1 which is not used for image forming out of the color ink 1 supplied on the ink carrier 2 is also squeezed off at the position of the contact and retrieved in the ink storage unit 12.

Further, by pushing the color ink 1 into the grooves using the blade 14 after the color ink 1 is scooped up by rotating the ink supply roller 13 and before the color ink 1 is transferred onto the ink carrier 2, the color ink is supplied in the grooves of the ink supply roller 13 more consistently. Additionally, useless color ink adhering on the groove portion of the ink supply roller 13 is removed.

Figure 16:
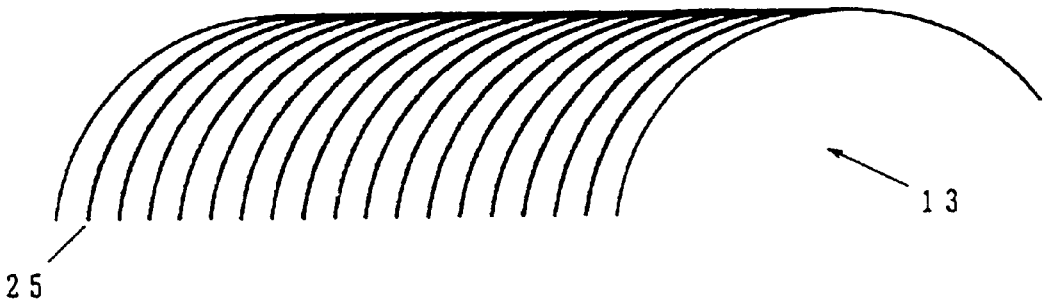
FIG. 16 is a schematic perspective view for illustrating another example of an ink supply roller used in the second embodiment of the present invention.

FIG. 16 is a schematic perspective view for illustrating another example of an ink supply roller in the second embodiment of the present invention. Alternatively, to form a stripe pattern of color ink 1 on the ink carrier 2, for example, as shown in FIG. 16, the ink supply roller 13 having the surface on which hydrophilic and hydrophobic stripe patterns are formed may be used. The ink supply roller 13 has the same structure as the ink supply roller 13 shown in FIG. 6 described hereinbefore, the only difference is the difference of hydrophilic and hydrophobic patterns formed on the ink supply roller 13.

The ink supply roller 13 shown in FIG. 16 is immersed partially in the ink storage unit 12, and when the ink supply roller is rotated, the color ink 1 adhering on the surface of the ink supply roller 13, particularly on the hydrophilic area, in the ink storage unit 12 is scooped up, excessive color ink 1, particularly color ink 1 adhering on the hydrophobic area, is scraped by the blade 14, and thus the stripe pattern color ink 1 is formed on the ink supply roller 13.

Figure 17:
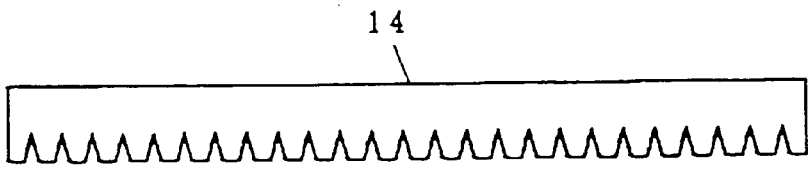
FIG. 17 is a schematic plan view for illustrating one example of a blade which is usable in the second embodiment of the present invention.

FIG. 17 is a schematic plan view for illustrating one example of a blade which is usable in the second embodiment of the present invention. Further alternatively to form a stripe pattern of the color ink 1 on the ink carrier 2, a blade 14 having a shape as shown in FIG. 17 may be used. This blade is used in contact with the ink carrier 2. On the edge of the blade 14, numerous grooves having a width, depth, and pitch corresponding to the stripe are formed. The width and depth of the grooves are designed in the same manner as described in FIG. 15 for the grooves formed on the ink supply roller 13.

The color ink 1 in the ink storage unit 12 is scooped up by the ink supply roller 13, and spread over the entire surface of the ink carrier 2. Thereafter, stripe patterned color ink 1 is formed on the surface of the ink carrier 2 by the blade 14 having the grooves as shown in FIG. 17.

Alternatively, as shown in FIG. 13 in the above-mentioned first embodiment, the ink carrier 2 is-immersed partially in the ink storage unit 12 directly to spread the color ink 1 on the entire surface, thereafter stripe patterned color ink 1 is formed on the ink carrier 2 using the blade 14 having the grooves as shown in FIG. 17. In this case, it is not necessary to form a water repellent area and a hydrophilic area in the form of a pattern on the surface of the ink carrier 2 unlike the third modified example in the above-mentioned first embodiment.

As the method to form the stripe pattern of the color ink 1 on the ink carrier 2, various methods, for example, a method in which the ink supply roller 13 is structured with an elastic member as shown in FIG. 5(A) and FIG. 5(B), may be used. The color ink 1 on the ink carrier 2 is heated in the same manner as described in the above-mentioned first embodiment, and structures as shown in FIG. 7 to FIG. 10 may be used, for example.

The color ink jetting is observed using the second embodiment of the image forming method of the present invention and the image forming apparatus for realizing the second embodiment as described hereinbefore and using color ink having the viscosity of 1 mPa·s to 100000 mPa·s. As the result, it is found that the printing energy required for one droplet of color ink to jet is 10 μJ or less for the color ink having the relatively low viscosity of approximately up to 100 ·mPa·s in the second embodiment of the present invention, in comparison with the printing energy of several tens μJ in the conventional heating ink jet system, and it is confirmed that color ink can be jetted with very small printing energy. Further, it is found that color ink having a high viscosity of 10000 mPa·s can be jetted stably though the same printing energy as required for the conventional system is required. However, color ink having a viscosity of 100000 mPa·s is jetted in unstable direction. The same result of forming of small dots, response speed when color ink is jetted, and supply speed of color ink as obtained in the first embodiment is obtained in the second embodiment. As described hereinabove, in the second embodiment, the same effect as obtained in the above-mentioned first embodiment is obtained in the second embodiment as long as the color ink having the viscosity of 10000 mPa·s or lower is used.

Next, the third embodiment of the image forming method of the present invention will be described. In the third embodiment, color ink 1 having a thin thickness of 20 μm or less, preferably 10 μm or less, is spread on the surface of the ink carrier 2, the ink carrier 2 is heated partially according to image information, and ink droplets are jetted. The cross section of the color ink 1 on the ink carrier 2 in this third embodiment is the same as that shown in FIG. 14(A) to FIG. 14(D) for either direction. The principle of the image forming method in the third embodiment is described hereinafter with reference to FIG. 14(A) to FIG. 14(D).

The color ink having a thickness of 20 μm or less, preferably 10 μm or less, is held on the ink carrier 2. When, the color ink 1 is continuous in either direction as shown in FIG. 14(A). In this state, for example, an area of the heating unit 3 which is hatched as shown in FIG. 14(B) is allowed to generate heat selectively. Alternatively, the area of the ink carrier 2 is heated externally. Then, the color ink 1 located on the heating unit 3 and the color ink 1 on the interface with the ink carrier 2 or its is boiled and evaporated, an air layer 4 is formed between the ink carrier 2 and the color ink 1 as shown in FIG. 14(B). Thereby the adhesion between the ink carrier 2 and the color ink 1 is reduced. In this state, the color ink 1 on the air layer 4 is in contact with the peripheral color ink 1 other than the area of the heating unit 3. Therefore, the color ink 1 on the air layer 4 receives a resistance force such as tension at the contact portions shown with broken lines in FIG. 14(B). However, the thickness of the peripheral color ink 1 is as thin as 20 μm or less, preferably 10 μm or less, and the quantity of contact ink is very small. Therefore, the resistance force exerted from the peripheral color ink 1 is small, the contact portion is broken by rapid volume expansion pressure of the air layer 4, and ink droplets 5 are jetted as shown in FIG. 14(C). Because only the color ink 1 on the area other than the area of the heating unit 3 is in contact and properties of the color ink 1 is uniform, the color ink on the area of the heating unit 3 is jetted in the form of ink droplets 5 in the perpendicular direction. The jetted ink droplets 5 adhere on a recording medium 6 as shown in FIG. 14(D), and recording is performed.

The liquid quantity of the jetted ink droplets 5 can be controlled so as to be constant when the color ink is held on the ink carrier 2, recording is performed with a stable liquid droplet quantity. The color ink having a very thin thickness brings about reduced consumption of the liquid quantity of ink droplets, and helps realize fine dots on a recording medium 6. Thus, a highly precise image is formed. In the method in which the color ink 1 is used in the form of thin layer as described hereinabove, the color ink 1 is spread thinly on the ink carrier 2 at high speed stably with a simple structure having a plain blade and a roller member.

As described hereinabove, the air layer 4 generated by heating weakens the resistance force due to contact between the color ink 1 and ink carrier 2, and in addition, the resistance force received from the surroundings is also reduced by forming the color ink 1 as a thin layer, therefore even though ink having high viscosity is used as the color ink 1, the incremental resistance force due to high viscosity is small, and the ink droplets 5 are jetted without a problem. Change to some degree in the viscosity does not affect jetting of the ink droplets 5. As described hereinabove, in the third embodiment of the present invention, the ink having the viscosity ranging from high to low viscosity can be jetted in the form of ink droplets 5 without a problem, and recording is performed.

Figure 18A:
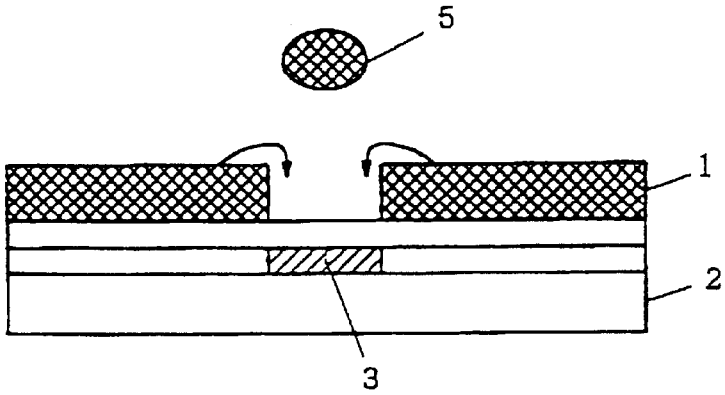
FIG. 18(A) to FIG. 18(C) are diagrams for describing the color ink after ink droplet jetting.
Figure 18B:
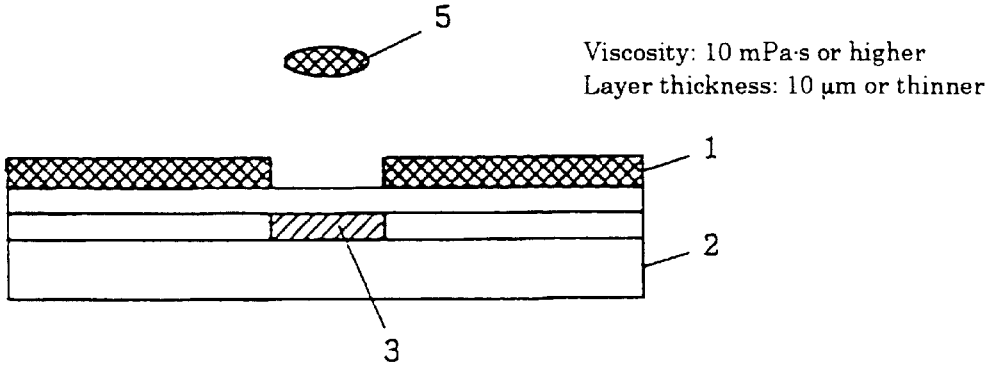
Figure 18C:
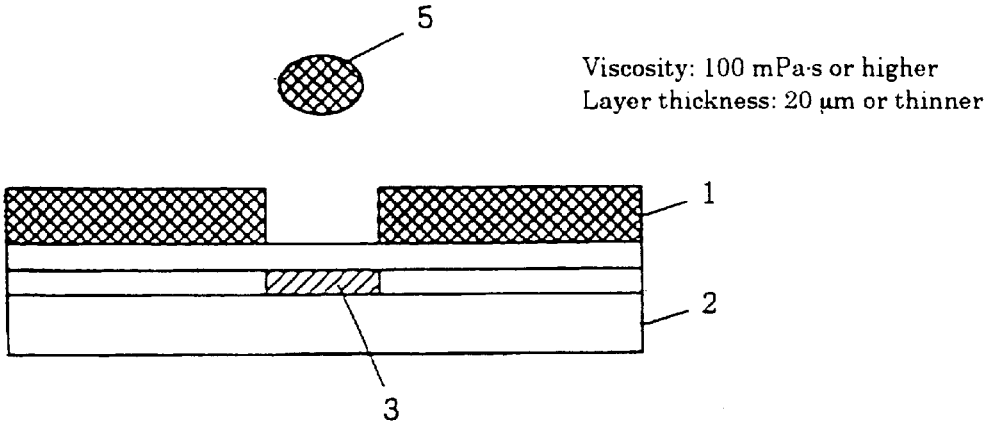

Use of high viscosity color ink 1 is advantageous, as it is true for the first and second embodiments, in that generation of feathering and bleeding is suppressed and a high quality image is formed. Further in the third embodiment, jetting performance of color ink 1 is improved by using high viscosity color ink 1. FIG. 18(A) to FIG. 18(C) are diagrams for illustrating the color ink after ink droplet jetting. For example, when color ink 1 having a low viscosity of 10 mPa·s or lower is used, as shown in FIG. 18(A), the color ink on the periphery of a blanked area where there is no color ink because of jetting away of the color ink 1 flows onto the blanked area. In the case of the conventional heating ink jet system, such flowing of the color ink functions as re-supply of the color ink. However, in the present invention, such flowing of the color ink causes instability in the ink surface and ink quantity, and causes unstable jetting of the color ink under high speed printing condition, and thus results in a poor image quality.

To solve this problem, the color ink having the viscosity of 10 mPa·s or higher is used in the third embodiment. By using the color ink having the viscosity of 10 mPa·s and by applying the ink layer thickness of 10 μm or less, the flow speed of the color ink onto the blanked area where there in no color ink due to jetting of the ink droplets are slowed down as shown in FIG. 18(B), and the ink droplets are jetted on other areas with stability of the ink surface and ink quantity. Thus, the ink droplets are jetted at high speed stably, and a high quality image is obtained. Further, with using the color ink having the viscosity of 100 mPa·s or higher, ink is jetted at high speed stably even though the thickness of the ink layer is 10 μm or more.

As a structure of the image forming apparatus to realize the third embodiment of the image forming method of the present invention, the same structure as shown in the above-mentioned first embodiment, for example, the structure shown in FIG. 2, and FIG. 11 to FIG. 13, may be applied. When, a thin even layer of the color ink 1 having a thickness of 20 μm or less, preferably 10 μm or less, is formed on the ink carrier 2.

A detailed method for forming an even thin layer of the color ink 1 on the ink carrier 2 is described. As the method for forming a thin layer using the ink supply roller 13, two methods are available: one is a method in which the ink supply roller 13 is brought into contact with the ink carrier 2 and the other is a method in which the ink supply roller 13 is not brought into contact with the ink carrier 2.

For example, in the case that the same image forming apparatus having the structure in which the ink supply roller 13 and the ink carrier 2 are brought into contact as that having the structure shown in FIG. 2 is used, the color ink 1 in the ink storage unit 12 is scooped up by the ink supply roller 13, the color ink 1 is transferred onto the ink carrier 2 at the position of the contact with the ink carrier 2, and useless color ink is squeezed off at the position of the contact. At this time, by controlling the contact pressure between the ink carrier 2 and the ink supply roller 13, the thickness of the ink layer to be spread on the ink carrier 2 is controlled. For example, the contact pressure is controlled in a range from 10 g/cm to 100 g/cm, thereby the ink layer having the thickness of 1 μm to 20 μm is formed correspondingly. In this method, because the ink carrier 2 and the ink supply roller 13 are required to be brought into contact securely, the ink supply roller 13 preferably has an elastic layer at least on the surface.

Figure 19:
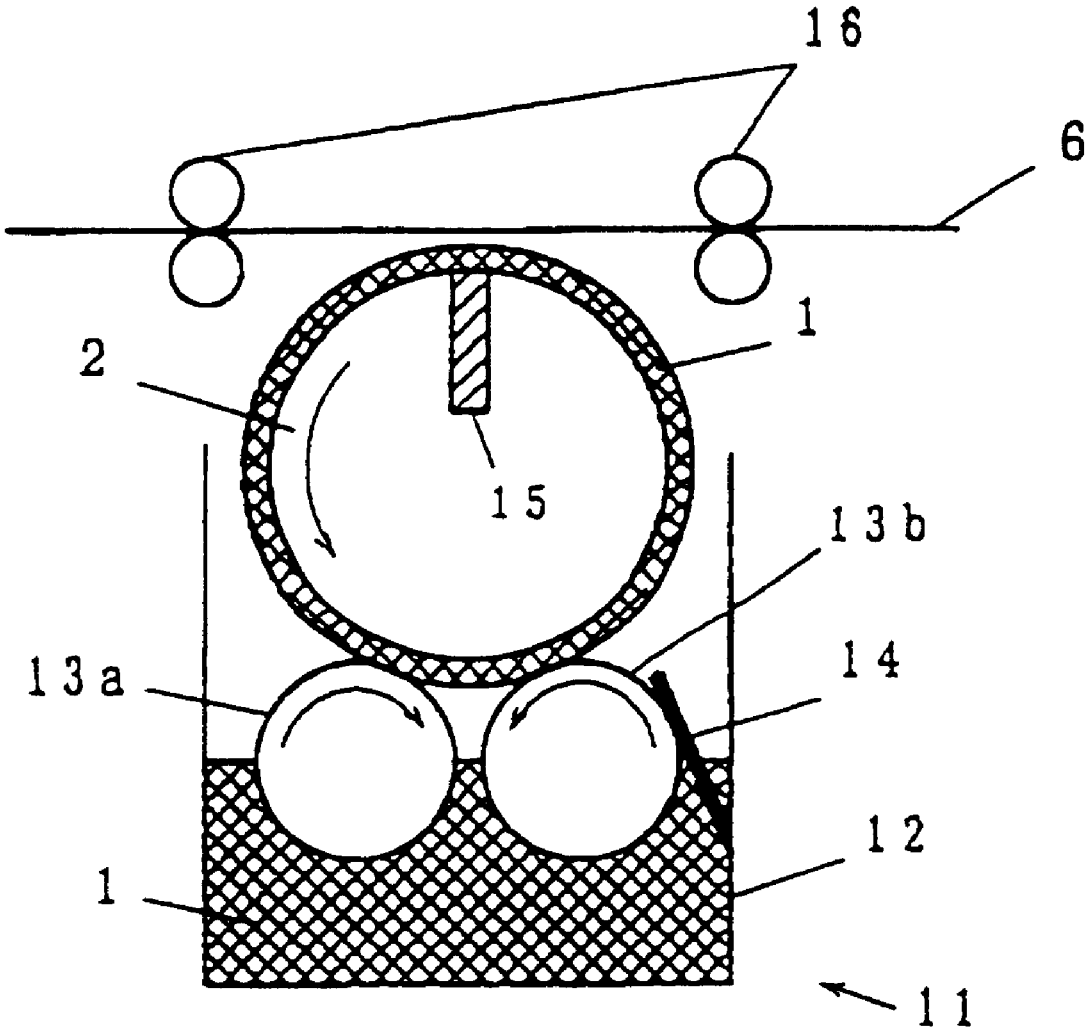
FIG. 19 is a schematic structural diagram for illustrating one example of an image forming apparatus used for implementing the third embodiment of the image forming method of the present invention.

FIG. 19 is a schematic structural diagram for illustrating one example of an image forming apparatus for realizing the third embodiment of the image forming method of the present invention. In the drawing, the same components as shown in FIG. 2 are given the same numbers, and a redundant description is omitted. 13*a* and 13*b* represent ink supply rollers. The structure shown in FIG. 19 shows an example in which an even thin layer of the color ink 1 is formed on the ink carrier 2 without contact between the ink supply rollers and the ink carrier 2.

In this example, two ink supply rollers 13*a* and 13*b* are used, and located respectively near the ink carrier 2 with interposition of a small clearance. On the up-stream side in the rotational direction of the ink carrier 2, the ink supply roller 13*a* is located, and the ink supply roller 13*a* is driven in the same direction as the ink conveying direction of the ink carrier 2. The ink supply roller 13*a* scoops up the color ink 1 in the ink storage unit 11, and supplies the color ink 1 on the entire surface of the ink carrier 2.

The ink supply roller 13*b* is located on the down stream side in the rotational direction of the ink carrier 2, and the ink supply roller 13*b* is driven rotatively in the direction reverse to the ink conveying direction of the ink carrier 2. The portion where the supply roller 13*b* and the ink carrier 2 are facing each other is filled with ink, shearing force is generated in the internal of the ink of the portion due to the relative speed between the ink supply rolier 13*b* and the ink carrier 2, and thus a thin layer of the color ink 1 having a desired thickness is formed on the ink carrier 2.

The thickness of the ink layer spread on the ink carrier 2 is controlled by the clearance between the ink carrier 2 and the ink supply roller 13*b* and the rotation speed of the ink carrier 2 and the ink supply roller 13*b*. In an example, the clearance is controlled in a range from 30 μm to 200 μm, and the ratio of the surface moving speed of the ink supply roller 13*b* to the surface moving speed of the ink carrier 2 is controlled in a range from 0.5 to 5, the ink layer having the thickness ranging from 1 μm to 20 μm is formed.

Useless color ink on the ink supply roller 13*b* is removed by the blade 14 before the ink layer comes to face to the ink carrier 2. The ink supply roller 13*b* does not require a function to supply the color ink basically, therefore it is not required to immerse the ink supply roller 13*b* in the ink storage unit 12.

Alternatively, as a different method for forming an even thin layer of the color ink 1 on the ink carrier 2, the color ink 1 in the ink storage unit 12 is scooped up using the ink supply roller 13, and spread over the entire surface of the ink carrier 2, thereafter excessive color ink is scraped off using the blade 14, and thus a thin layer of the color ink 1 having an even thickness is formed on the ink carrier 2. Further alternatively, the ink carrier 2 is immersed directly in the ink storage unit 12 as shown in FIG. 13, and the color ink 1 is spread over the entire surface of the ink carrier 2, thereafter excessive color ink is scraped off using the blade 14 similarly, and a thin layer of the color ink 1 having the even thickness is formed on the ink carrier 2. In this method, the thickness of the ink layer is controlled by the contact pressure of the blade 14. For example, the contact pressure is controlled in a range from 1 g/cm to 100 g/cm, thereby the ink layer having the thickness ranging from 1 μm to 20 μm is formed.

In the color ink thin layer spreading method described hereinabove, the method in which the ink supply roller is not in contact is used when the color ink having the relatively low viscosity is used and on the other hand the method in which the ink supply roller or the blade is in contact is used when the color ink having the relatively high viscosity is used, so that the ink speed thickness is easily controlled. For heating the color ink 1, the same various heating methods as described in the above-mentioned first embodiment may be used.

FIG. 20 is a diagram for describing one relation between the ink viscosity and ink layer thickness when the third embodiment of the image forming method of the present invention and the image forming apparatus for implementing the third embodiment are used. Color ink jetting of the color ink having the viscosity ranging from 1 mPa·s to 100000 mPa·s is observed using the image forming method described in the third embodiment of the present invention and the image forming apparatus for implementing the image forming method. The result is shown in FIG. 20. In the drawing, the printing energy used for jetting one ink droplet is 30 μJ, this value is the same as that used in the conventional heating ink jet system, and the heating area is 50 μm×50 μm. In the drawing, A represents stable good ink jetting, B represents unstable jetting of ink droplets, and C represents no jetting of ink droplets.

As shown in FIG. 20, the ink layer having a thickness of 20 μm or more consisting of the color ink having the high viscosity of 100 mPa·s or higher cannot be jetted with the printing energy (30 μJ/droplet) that is the same as used in the conventional heating ink jet system. The reason is that the resistance force which the color ink on the heated area receives from the peripheral color ink on the non-heated area is large and prevents the color ink from jetting. In the case of the color ink having the low viscosity ranging from 1 mPa·s to 100 mPa·s, though ink droplets are jetted, because of unstable ink surface, ink droplets are jetted in the unstable direction, and because of severe misting (scattering of ink droplets), ink droplets are jetted unstably.

Accordingly, in the third embodiment, the thickness of the ink layer spread on the ink carrier 2 should be 20 μm or less, preferably less than 10 μm. As long as the thickness of the ink layer is in the range, the color ink having the high viscosity ranging from 100 mPa·s to 1000 mPa·s can be jetted stably with the same printing energy as used in the conventional heating ink jet system. It is obvious from FIG. 20 that for the thickness of the ink layer of 10 μm or less, the color ink having the viscosity of 10 mPa·s or higher is jetted stably, and for the thickness of the ink layer of 10 μm to 200 μm, the color ink having the viscosity of 100 mPaμs or higher is jetted stably.

As for the dot diameter formed on a recording medium 6, by forming the very thin ink layer on the ink carrier 2, the dot which is very smaller than that of the conventional ink jet system can be formed. For example, in the case that the ink layer having the layer thickness of 5 μm is formed on the ink carrier 2, it is confirmed that the dot having a size of 30 μm can be formed. The same high response speed and the high ink supply speed for color ink jetting as attained in the above-mentioned first embodiment is attained in this embodiment.

Some applied examples and modified examples which are common to the above-mentioned first to third embodiments are described hereinafter. Herein, examples are described using the structure shown in FIG. 2, however, the examples are not limited to the case, structures shown in FIG. 11 to FIG. 13, FIG. 19, and the above-mentioned various modifications may be used.

Figure 21:
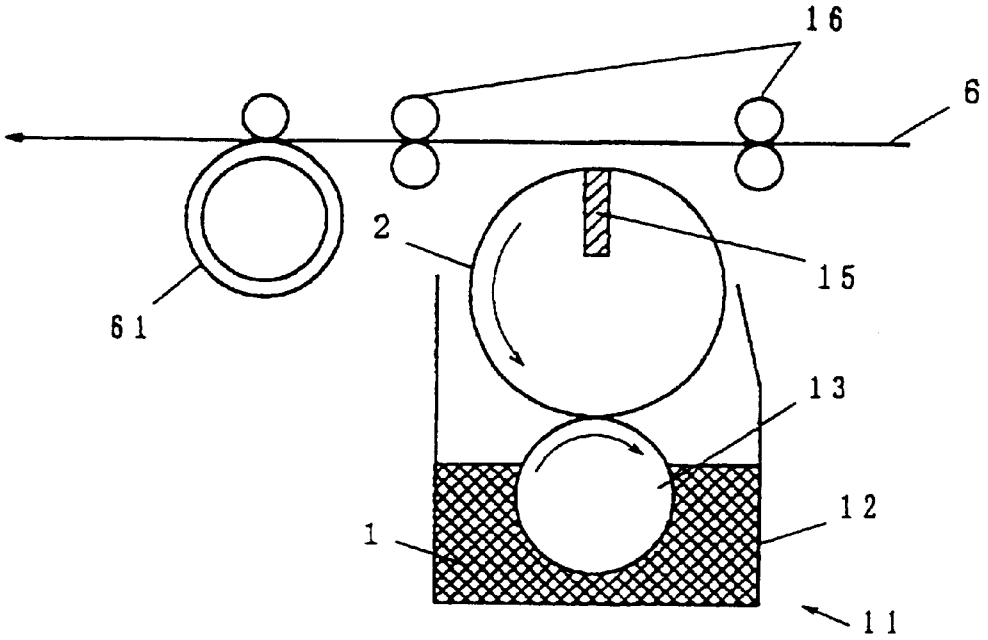
FIG. 21 is a schematic structural diagram for illustrating the first applied example of the image forming apparatus of the present invention.

FIG. 21 is a schematic structural diagram for illustrating the first applied example of the image forming apparatus of the present invention. In the drawing, 61 represents a press unit. In the first applied example, a recording medium 6 is pressed by the press unit 61 after an image is recorded. In the above-mentioned first to third embodiments, the high viscosity color ink is used, however, use of color ink having the very high viscosity of, for example, 1000 mPaμs or higher result in the rough surface of an image and poor glossiness of the image because penetration of the color ink into a recording medium is slow and remaining color ink is dried as it is. To solve this problem, in the first applied example, by pressing the recording medium on which an image is formed with the color ink 1 with the press unit 61, the color ink 1 is embedded into the recording medium 6 or flattened, the surface roughness of the image on the recording medium 6 is lessened.

The press unit 61 is brought into contact with the image of the color ink 1 formed on the recording medium 6. Therefore it is desirable to structure the press unit 61 so that the press surface moves synchronously with the recording medium 6 to avoid the deterioration of the image due to friction, for example a roller shaped member is used as the press unit 61. As the roller shaped member, for example, a metal roller having an elastic surface layer may be used. It is desirable to form a water repellent layer on the surface so as not to disturb the image due to adhesion of the color ink on the roller shaped member. Materials described in the above-mentioned first embodiment may be used for the water repellent layer. In the case that the press unit 61 is structured with the roller shaped member, the press force on the recording medium 6 ranging from 1 g/cm to 100 g/cm is sufficient for use.

Even though the image is formed using the color ink having the high viscosity, by pressing the recording medium 6 with the press unit 61, the color ink is sufficiently embedded into the recording medium 6 and flattened , and thus the problem of surface roughness is solved.

Figure 22:
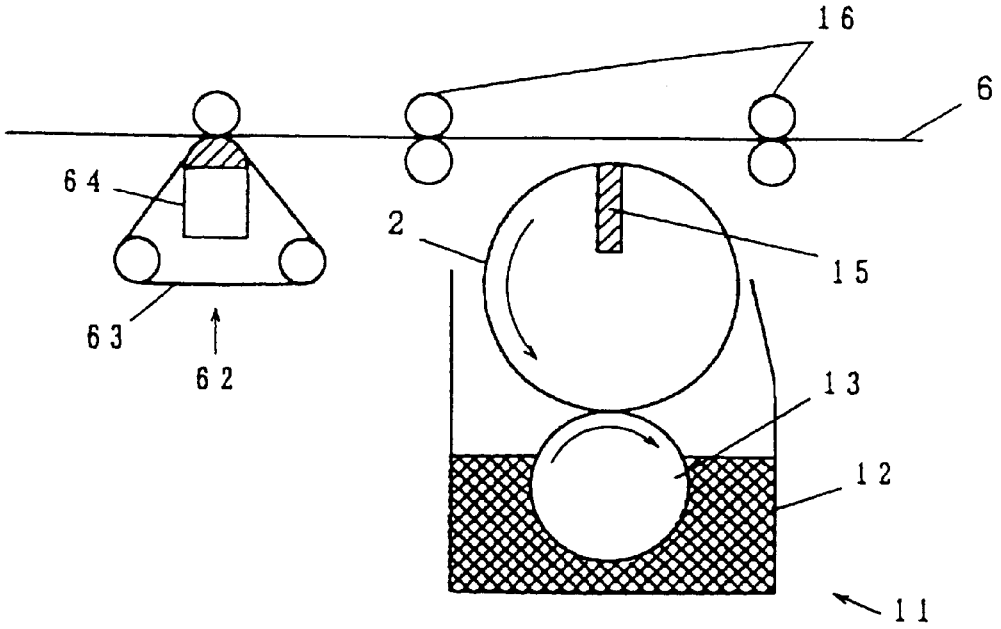
FIG. 22 is a schematic structural diagram for illustrating the second applied example of the image forming apparatus of the present invention.

FIG. 22 is a schematic structural diagram for illustrating the second applied example of the image forming apparatus of the present invention. In the drawing, 62 represents heating press unit, 63 represents a belt member, and 64 represents a heater head. In this second applied example, a recording medium 6 is pressed and heated by the heating press unit 62 after an image is recorded. For example, the drying speed of the color ink is slow when color ink having very high viscosity of 1000 mPa·s or higher is used, and if the image forming speed is high, the drying speed cannot follow the image forming speed, as the result high speed operation cannot be implemented. To solve this problem, in the second applied example, the recording medium 6 on which an image of the color ink is formed is pressed and heated by the heating press unit 62, the drying speed of the color ink is increased, and the high speed recording is implemented.

The heating press unit 62 is composed of, for example, the belt member 63 and the heater head 64 for heating and pressing the belt member 63. As described in the above-mentioned first applied example, when the recording medium 6 is pressed, it is desirable to move the press surface of the press member synchronously with the recording medium 6 so that the deterioration of the image due to friction is prevented when the image of the color ink 1 formed on the recording medium 6 is brought into contact with the surface of the heating press unit 62. To solve this problem, the belt member 63 is used as the member for pressing. Because the wall thickness of the belt member 63 can be thin unlike that of the roller, small energy for heating the belt itself is sufficient for use, and the apparatus can be used immediately after the switch is turned on. As the belt member 63, films having high heat resistance and mechanical strength such as endless films of PET and polyimide may be used. A water repellent layer is formed desirably on the surface so that the image is not disturbed due to adhesion of the color ink on the belt member 63.

In this example, the recording medium 6 is heated from the back side of the belt member 63 by the heater head 64. For example, the heater head 64 heats at a temperature in a range from 50 to 150 degrees Celsius. The heater head 64 also functions to press the belt member 63 against the recording medium 6. The press force may range, for example, from 1 g/cm to 100 g/cm.

Alternatively, as the structure of the heating press unit 62, a structure of a roller provided with a heating unit such as a halogen lamp in the internal or a member having a heater layer on the roller or belt structure itself may be used.

According to the second applied example, even in the case of image output speed of 20 sheets per minute using the high viscosity color ink, the color ink is dried sufficiently. The second applied example brings about high speed recording as described hereinabove.

Figure 23:
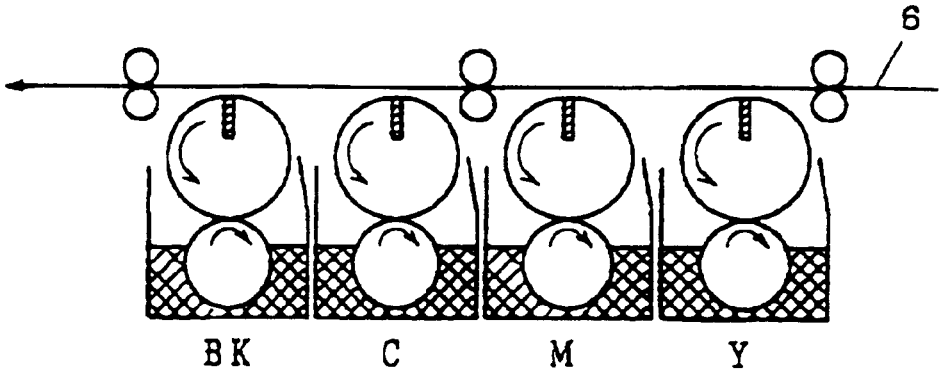
FIG. 23 is a schematic structural diagram for illustrating the third applied example of the image forming apparatus of the present invention.

FIG. 23 is a schematic structural diagram for illustrating the third embodiment of the image forming apparatus of the present invention. In all the above-mentioned examples, processes for forming a monochromatic image are described. The present invention is by no means limited to the case of monochromatic image. For example, as shown in FIG. 23, a mechanism for forming images of the present invention composed of three colors or more including at least yellow, magenta, and cyan, preferably four or more colors including at least black additionally is provided, and images of the respective colors are formed successively on a recording medium 6 to obtain a color image. As described hereinabove, the present invention is applied to such a color process.

In this invention, because color ink having high viscosity is used, even though a color image is formed by overprinting plural kinds of ink of different colors one on another on a recording medium using the process as shown in FIG. 23, no bleeding is caused, and a high quality color image is obtained.

Figure 24:
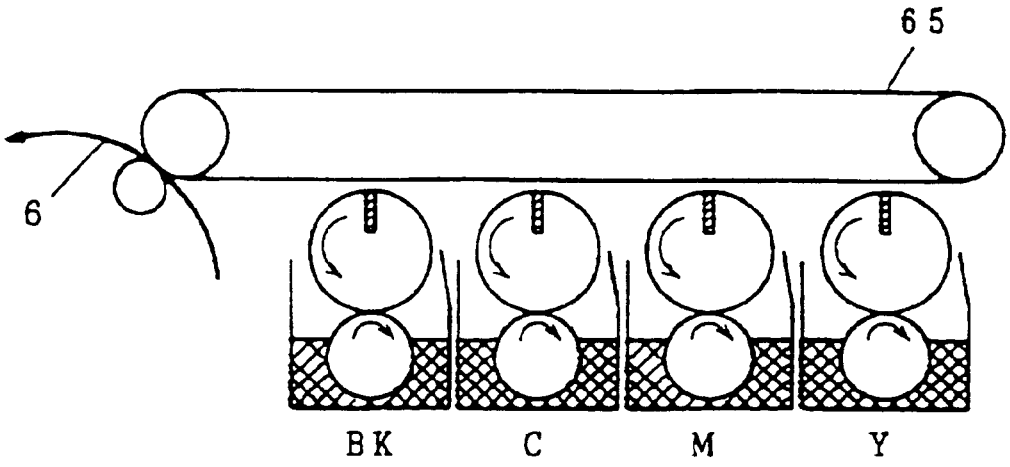
FIG. 24 is a schematic structural diagram for illustrating the fourth applied example of the image forming apparatus of the present invention.
Figures 25A, 25B, 25C, 25D, 25E:
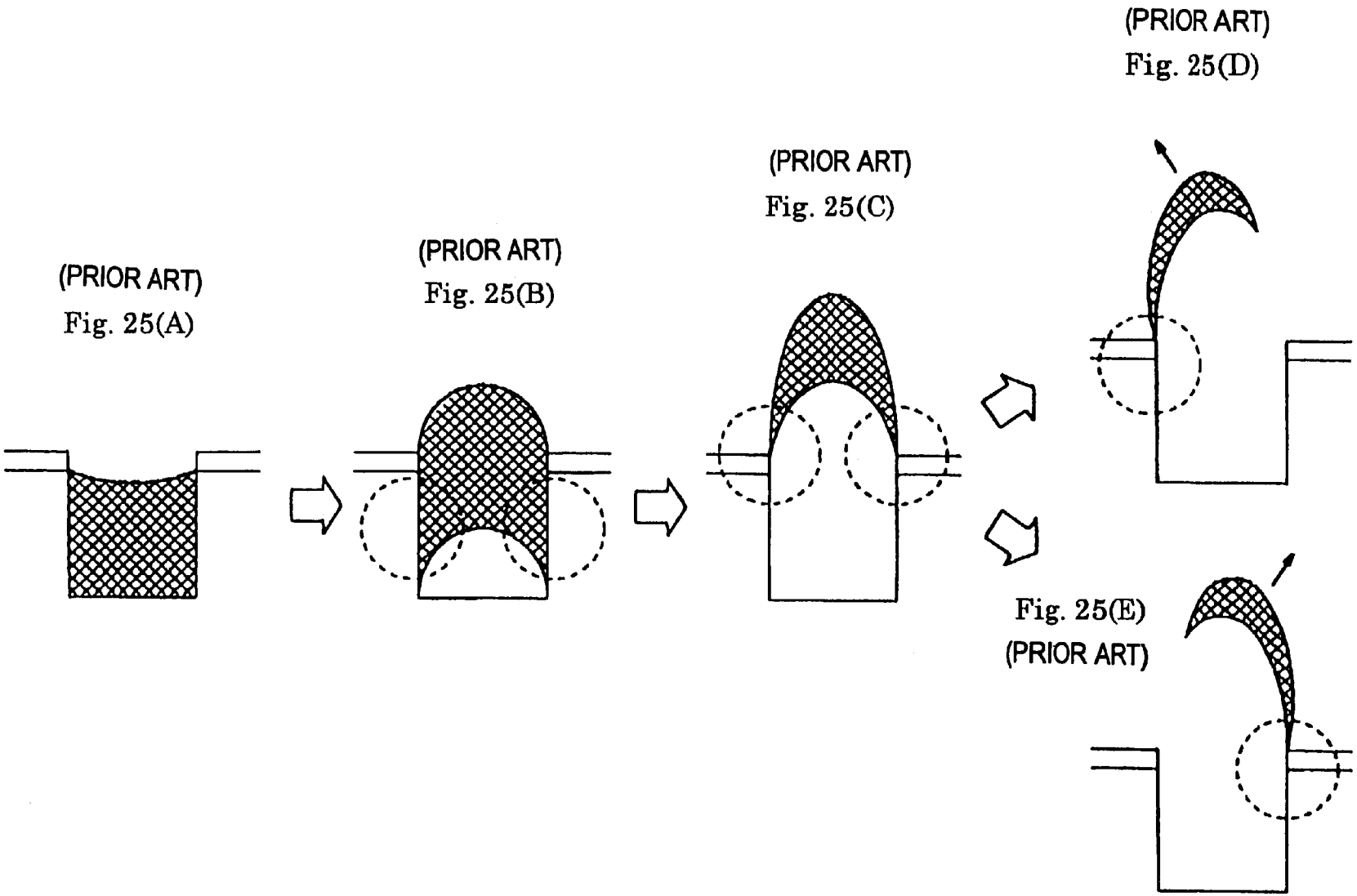
Fig. 25(A) (PRIOR ART)
Fig. 25(B) (PRIOR ART)
Fig. 25(C) (PRIOR ART)
Fig. 25(E) (PRIOR ART)
FIG. 25(A) to FIG. 25(E) are diagrams for describing one example of the conventional ink jet recording system having no nozzle.

FIG. 24 is a schematic structural diagram for illustrating the fourth applied example of the image forming apparatus of the present invention. In the drawing, 65 represents an intermediate transfer medium. In the above-mentioned third embodiment, an image is formed by direct adhesion of color ink on a recording medium, however alternatively, as shown in, for example, FIG. 24, images are formed by adhesion of plural kinds of color ink on the intermediate transfer medium 65, and the images are transferred onto a desired recording medium 6 to form an image.

In this structure, a high quality color-image can be obtained as the above-mentioned third applied example. Because a recording medium 6 is pressed when images formed on the intermediate transfer medium are transferred onto the recording medium 6, the surface roughness on the recording medium 6 is reduced as it is true for the above-mentioned first applied example.

As the structure for forming a color image, alternatively a structure other than structures shown in the above-mentioned third and fourth applied examples may be used in which one mechanism for forming images is provided, and the color ink itself supplied to the ink supply roller 13 or the ink carrier 2 is switched to form a multi-color image.

Further, in all the above-mentioned embodiments and applied examples, the case in which a recording medium is moved is described, however the present invention is by no means limited to the case, the structure may be used in which a recording medium remains stationary and structural components for forming images are moved. Further, a recording medium and also structural components may be moved. When the image which covers the entire surface of a recording medium is formed, both a recording medium and structural components may be stationary at least during the time period of recording.

The present invention is applied to various image forming apparatuses such as copying machines, printers, plotters, facsimile machines, and printing machines.

Each of the above-mentioned embodiments and applied examples is merely one embodiment in accordance with the present invention, the present invention is by no means limited to the above-mentioned examples, the present invention is modified variously within the scope of the present invention.

As obvious from the above-mentioned description, according to the present invention, ink is held on the flat surface of an ink carrier in the form of an even pattern, particularly in the form of isolated ink droplets or stripes, or in the form of an even thin layer having a thickness of 20 $\mu$m or less, the ink carrier is heated correspondingly to image information to jet the ink. Because the surface of the ink carrier for holding ink is flat, at the time when an air layer is formed just before the ink is jetted, the ink is scarcely in contact with the ink carrier, the resistance force exerted from the ink carrier is very small. The ink to be jetted is in contact with only the peripheral ink, the resistance force is small. Therefore, droplets of the ink having the viscosity ranging widely from low to high viscosity can be jetted at high speed with small energy, and an image is formed. At this time, even though the ink viscosity changes somewhat, the force which is exerted on the ink to be jetted does not change so significantly, the influence on the ink jetting is very small. Further, even though the ink is in contact with the peripheral ink when the ink is to be jetted, because the ink is in contact with the ink each other, the characteristics is uniform, the ink is jetted stably in the perpendicular direction.

Because the quantity of jetting ink is determined to be constant when color ink is spread on the ink carrier by an ink supply unit, the quantity of jetting ink is stable. By forming the ink pattern fine or by forming the ink layer thin, ink supply is reduced, and fine dots are reproduced. Thereby a highly precise image can be formed.

Because the ink is held on the ink carrier and conveyed and supplied continuously, the ink supply speed is determined by conveying speed of the ink carrier, ink is supplied at high speed regardless of the viscosity of the ink.

Further, a unit for pressing a recording medium or a unit for heat pressing a recording medium on which an image consisting of the ink is formed may be provided, and in this case, even though ink having high viscosity is used, the surface roughness of the image is reduced, and additionally, ink drying speed is fast, thus high speed operation is implemented.

Therefore, according to the image forming method and the image forming apparatus of the present invention, ink having high viscosity is jetted stably at high speed in the form of small droplets without incremental energy consumption or with small energy consumption, and a high quality and highly precise image is formed on various recording media without feathering and bleeding, such advantages are the effect of the present invention.

What is claimed is:

1. An image forming method in which ink is held:

on the surface of an ink carrier in the form of a uniform pattern, said ink carrier is partially heated correspondingly to image information, said ink is boiled on the interface or near the interface between said ink carrier and said ink, said ink is jetted by the pressure of a bubble generated from boiling and adheres on a recording medium located near said ink carrier with interposition of a small clearance to form an image.

2. The image forming method as claimed in claim 1, wherein said ink pattern held on said ink carrier is of ink droplets isolated individually.

3. The image forming method as claimed in claim 1, wherein said ink pattern held on said ink carrier is of stripes.

4. An image forming method in which ink is held on the flat surface of an ink carrier as an even thin layer having a thickness of 20 $\mu$m or less, said ink carrier is partially heated correspondingly to image information, said ink is boiled on the interface or near the interface between said ink carrier and said, ink said ink is jetted by the pressure of a bubble generated from boiling and adheres on a recording medium located near said ink carrier with interposition of a small clearance to form an image.

5. The image forming method as claimed in claim 4, wherein the viscosity of said ink is 10 mPa·s or higher.

6. The image forming method as claimed in claim 1, wherein said recording medium is pressed after an image consisting of said ink is formed on said recording medium.

7. The image forming method as claimed in claim 1, wherein said recording medium is pressed and heated after an image consisting of said ink is formed on said recording medium.

8. An image forming apparatus provided at least with an ink carrier having a flat surface that holds ink, an ink supply unit that supplies said ink on said ink carrier in the form of a uniform pattern, a heating unit that heats partially said ink carrier correspondingly to image information, and a conveying unit located facing to said heating unit that relatively conveys a recording medium while holding a small clearance to said ink carrier, wherein said ink on said ink carrier is jetted by heating by said heating unit to adhere on said recording medium.

9. The image forming apparatus as claimed in claim 8, wherein said ink pattern held on said ink carrier is of ink droplets isolated individually.

10. The image forming apparatus as claimed in claim 8, wherein said ink pattern held on said ink carrier is of stripes.

11. An image apparatus provided at least with an ink carrier having a flat surface that holds ink, an ink supply unit that supplies said ink on said ink carrier in the form of a uniform thin layer, a heating unit that heats partially said ink carrier correspondingly to image information, and a conveying unit located facing to said heating unit that relatively conveys a recording medium while holding a small clearance to said ink carrier, wherein the thickness of said thin layer of said ink supplied on said ink carrier is 20 $\mu$m or less, and said ink on said ink carrier is jetted by heating by said heating unit to adhere on said recording medium.

12. The image forming apparatus as claimed in claim 11, wherein the viscosity of said ink is 10 mPa·s or higher.

13. The image forming apparatus as claimed in claim 8, wherein a press unit that presses said recording medium on which an image consisting of said ink is formed is provided.

14. The image forming apparatus as claimed in claim 8, wherein a heat pressing unit that presses and heats said recording medium on which an image consisting of said ink is formed is provided.

* * * * *